United States Patent [19]

Ueda et al.

[11] Patent Number: 4,894,320

[45] Date of Patent: Jan. 16, 1990

[54] PHOTOGRAPHIC METHOD USING BLEACHING SOLUTION CONTAINING FERRIC COMPLEX SALTS AND AN AROMATIC COMPOUND

[75] Inventors: Shinji Ueda; Masakazu Morigaki; Kozo Aoki, all of Kanagawa, Japan

[73] Assignee: Fuji Photo Film Co., Ltd., Kanagawa, Japan

[21] Appl. No.: 101,319

[22] Filed: Sep. 25, 1987

[30] Foreign Application Priority Data

Sep. 25, 1986 [JP] Japan ..... 61-224905

[51] Int. Cl.[4] ..... G03C 7/42

[52] U.S. Cl. ..... 430/393; 430/430; 430/460; 430/461

[58] Field of Search ..... 430/430, 491, 393, 460, 430/461, 400, 434, 446, 448; 436/566

[56] References Cited

U.S. PATENT DOCUMENTS

| | | | |
|---|---|---|---|
| 3,832,393 | 8/1974 | Kruger et al. | 558/84 |
| 3,959,361 | 5/1976 | Kruger et al. | 260/502.5 |
| 4,264,716 | 4/1981 | Vincent et al. | 430/467 |
| 4,482,626 | 11/1984 | Twist et al. | 430/491 |
| 4,546,068 | 10/1985 | Kuse | 430/491 |
| 4,552,834 | 11/1985 | Lau et al. | 430/393 |
| 4,596,765 | 6/1986 | Kurematsu et al. | 430/491 |

FOREIGN PATENT DOCUMENTS

| | | |
|---|---|---|
| 0248450 | 9/1987 | European Pat. Off. . |
| 1230121 | 4/1971 | United Kingdom . |
| 1230172 | 4/1971 | United Kingdom . |
| 1319878 | 6/1973 | United Kingdom . |
| 1334834 | 10/1973 | United Kingdom . |

OTHER PUBLICATIONS

Research Disclosure #17048, Jun. 1978, pp. 58–59.
Research Disclosure #18837, Dec. 1979, pp. 692–693.

*Primary Examiner*—Hoa Van Le
*Attorney, Agent, or Firm*—Sughrue, Mion, Zinn, Macpeak & Seas

[57] ABSTRACT

A method of processing an imagewise exposed silver halide color photographic material comprising developing the material with a color developing solution, and then processing the material with a solution having a bleaching ability, wherein the processing solution having a bleaching ability contains a ferric complex salt comprising, as a complexing agent, an aromatic compound having at least one group represented by the following general formula (I):

(I)

wherein X represents a hydrogen atom or an organic or inorganic cation, A represents a single bond or a divalent linking group, and R represents a hydrogen atom, an aliphatic group, an aromatic group, a heterocyclic ring group, an acyl group, a sulfonyl group, A or $—CH_2PO_3X_2$.

9 Claims, No Drawings

PHOTOGRAPHIC METHOD USING BLEACHING SOLUTION CONTAINING FERRIC COMPLEX SALTS AND AN AROMATIC COMPOUND

FIELD OF THE INVENTION

The present invention relates to a method of processing imagewise exposed silver halide color photographic materials (hereinafter referred to as color photographic materials). More particularly, the present invention relates to an improved method of processing color photographic materials capable of performing sufficient desilvering within a short period of time without impairing the photographic characteristics, and resulting in a smaller amount of waste liquor.

BACKGROUND OF THE INVENTION

Generally, the basic steps of processing color photographic materials comprise a color developing step and a desilvering step. In the color developing step, imagewise exposed silver halide is reduced with a color developing agent to produce silver, and the oxidized color developing agent reacts with color forming couplers to form dye images. In the following desilvering step, the silver produced in the color developing step is oxidized by the action of an oxidizing agent (the so-called bleaching agent) and is then dissolved by a complexing agent (the so-called fixing agent) of a silver ion. Through this desilvering step, only dye images are formed in the thus-processed color photographic material.

To carry out the above desilvering step, there are two basic methods generally employed: (1) using two baths, that is, a bleaching bath containing a bleaching agent and a fixing bath containing a fixing agent; (2) using one bath, that is, a bleach-fixing bath containing a bleaching agent and a fixing agent together.

In practice, in addition to the above basic types of desilvering steps, a developing process normally includes various auxiliary steps for retaining the photographic and physical qualities of the image or for improving the quality of the image during storage. For example, such practical developing processes further include a hardening bath, a stop bath, an image stabilizing bath and a washing bath.

Bleaching agents are generally known, and include, for example, red prussiate, dichromates, ferric chloride, aminopolycarboxylic acid ferric complex salts and persulfates.

However, red prussiate and dichromates generally cause environmental problems due to the need to dispose of cyanides and hexavalent chromium compounds, and their use requires special processing facilities. If ferric chloride is used, there are, in practice, various obstacles to be overcome in view of problems such as the formation of iron hydroxide in the subsequent washing step, as well as the occurrence of stain. Persulfates are very weak in their bleaching ability, and thus disadvantageously require very prolonged bleaching time. Further, although methods additionally employing a bleaching accelerator are suggested, since persulfates are designated as dangerous articles, various measures must be taken to store them. Therefore, they are disadvantageously problematic for practical usage.

Aminopolycarboxylic acid ferric complex salts (particularly, ethylenediaminetetraacetic acid ferric complex salt) are accompanied by few environmental problems. Thus, they are currently most widely used. However, the bleaching power of aminopolycarboxylic acid ferric complex salts could withstand some improvement, and when a silver halide color photographic material composed mainly of a silver chlorobromide emulsion having a relatively low sensitivity is subjected to bleaching or bleach-fixing by using this type of bleaching agent, sufficient desilvering can be attained. However, when a color photographic material composed mainly of a bromochloroiodide emulsion or a bromoiodide emulsion which is color-sensitized and has a relatively high sensitivity (in particular, a color reversal photographic material for films using an emulsion having a high quantity of silver, or a color negative photographic material for films) is processed using this type of bleaching agent, it is disadvantageous in that insufficient desilvering occurs, or bleaching takes a longer period of time. For example, when a color negative photographic material for films is bleached using a bleaching solution containing an aminopolycarboxylic acid ferric complex salt, a bleaching period of at least 4 minutes is required, and to retain sufficient bleaching power, a complicated method including controlling the pH of the bleaching solution and aerating the solution, is required. Even when such a complicated method is used in practice, however, insufficient bleaching occurs often.

Further, after the bleaching process, to fully effect desilvering, the photographic material should be processed with a fixing solution for at least 3 minutes. Thus, it is eagerly desired to shorten the processing time for this type of desilvering process.

On the other hand, as a measure to reduce the time required for the desilvering step, it is known to use a bleach-fixing solution containing both an aminopolycarboxylic acid ferric complex salt and a thiosulfate as described in German Pat. No. 866,605, but when an aminopolycarboxylic acid ferric complex salt that has a weak oxidizing power (bleaching power) itself is copresent with a thiosulfate having a reducing power, the bleaching power becomes very weak, so that it is quite difficult to sufficiently desilver a color photographic material for films high in sensitivity and silver content, and this method is also impractical. Of course, to overcome the disadvantages of such a bleach-fixing solution, various attempts have been made. For example, such attempts include the methods described in British Pat. No. 926,569 and Japanese Patent Publication No. 11854/78 wherein an iodide or a bromide is added to the solution, and the method described in Japanese Patent Application (OPI) No. 95834/73 (the term "OPI" as used herein refers to a "published unexamined Japanese patent application") wherein triethanolamine is used to allow a highly concentrated aminopolycarboxylic acid ferric complex salt to be contained in the bleach-fixing solution, but the effects of such attempts are not satisfactory to attain the desired practical results.

In addition to insufficient desilvering ability, bleach-fixing solutions also are problematic in that cyan dyes formed by color development may be reduced to leuco dyes, thus adversely affecting color reproduction. To overcome this defect, for example, U.S. Pat. No. 3,773,510 suggests increasing the pH of a bleach-fixing solution. However, increasing the pH of a bleach-fixing solution results in a further decrease in the bleaching power, which is unacceptable from a practical viewpoint. Further, in U.S. Pat. No. 3,189,452, a method is disclosed wherein after bleach-fixing, leuco dyes can be oxidized with a red prussiate solution to reconvert them to cyan dyes, but the use of red prussiate is accompanied by the environmental problems as mentioned above, and if bleaching is carried out after the bleach-fixing, there is little effect seen as to decreasing the amount of remaining silver.

Further, with a view toward preventing environmental pollution, it is required to recover and treat photographic processing liquids that are high in biochemical oxygen demand (BOD) and chemical oxygen demand (COD), and the development of a method of processing color photographic materials wherein the amount of waste liquor is reduced contributes to lowering the recovery and treatment costs of the waste liquors, and thus is keenly desired.

SUMMARY OF THE INVENTION

Therefore, a first object of the present invention is to provide a method of processing color photographic materials by using a novel complexing agent.

A second object of the present invention is to provide a rapid method of processing color photographic materials (particularly those having high sensitivity and a high silver content) wherein silver is sufficiently removed within a short period of time without adversely affecting the photographic characteristics.

A third object of the present invention is to provide an economical method of processing color photographic materials wherein the amount of waste liquor is desirably reduced, and the recovery and treatment costs of the waste liquor are low.

These and other objects of the present invention can be attained by providing a method of processing an imagewise exposed silver halide color photographic material comprising developing the material with a color developing solution, and then processing the material with a solution having a bleaching ability, wherein the processing solution having a bleaching ability contains a ferric complex salt comprising, as a complexing agent, an aromatic compound having at least one group represented by the following general formula (I):

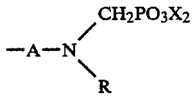

(I)

wherein X represents a hydrogen atom or an organic or inorganic cation, A represents a single bond or a divalent linking group, and R represents a hydrogen atom, an aliphatic group, an aromatic group, a heterocyclic group, an acyl group, a sulfonyl group, A or $—CH_2PO_3X_2$ as defined above.

DETAILED DESCRIPTION OF THE INVENTION

Aromatic compounds having at least one group represented by general formula (I) are described in detail below.

X represents a hydrogen atom, or an organic or inorganic cation (e.g., ammonium, triethylammonium, sodium, potassium, calcium, magnesium and iron).

A represents a single bond or a divalent linking group (e.g., $—CH_2—$, $—CH_2CH_2—$,

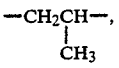

$—OCH_2CH_2—$, $—NHCH_2CH_2—$, $—CH_2NHCH_2CH_2—$,

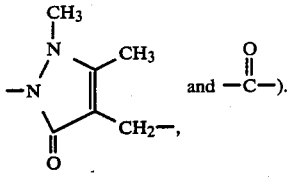

R represents a hydrogen atom, an aliphatic group, an aromatic group, a heterocyclic group, an acyl group preferably having up to 14 carbon atoms (e.g., an acetyl group, a benzoyl group, a butyryl group, a valeroyl group, a pivaloyl group and a myristoyl group), a sulfonyl group preferably having up to 7 carbon atoms (e.g., a methanesulfonyl group, an ethanesulfonyl group, a benzenesulfonyl group and a p-toluenesulfonyl group), A or $CH_2PO_3X_2$.

Herein, the aliphatic group refers to a linear, branched or cyclic alkyl group, alkenyl group or alkinyl group all of which have from 1 to 11 carbon atoms and preferably from 1 to 4 carbon atoms and which may be substituted. Specific examples of the aliphatic groups include a methyl group and a carboxymethyl group. The aromatic group has at least 5 carbon atoms and preferably 6 or more carbon atoms, which may be of a monocyclic type or condensed ring type, and may be substituted. The heterocyclic group may be any of a 3- to 10-membered ring containing a hetero atom such as a nitrogen atom and a sulfur atom, may have a condensed aromatic ring or a condensed heterocyclic ring, and may be substituted, if desired. Specific examples of the heterocyclic group include a triazolyl group, a diazolyl group, a thiadiazolyl group and an oxazolyl group.

Preferably, the aromatic compounds having at least one group represented by general formula (I) are benzene compounds and naphthalene compounds, with benzene compounds being particularly preferred. The aromatic compounds may be substituted by a substituent in addition to groups represented by general formula (I). The number of groups represented by general formula (I) is at least 1, preferably from 1 to 6, more preferably from 1 to 4, and most preferably 2.

The aromatic compounds having at least one group represented by general formula (I) are more preferably compounds represented by the following general formula (II):

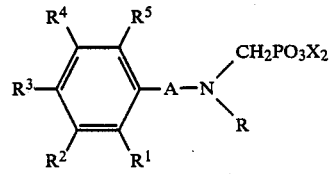

(II)

wherein X, R and A have the same meaning as defined in general formula (I), $R^1$, $R^2$, $R^3$, $R^4$ and $R^5$, which may be the same or different , each represents a hydrogen atom, an aliphatic group, an aromatic group, a heterocyclic group, an alkoxy group, an aryloxy group, an alkylthio group, an arylthio group, an alkylamino group, an acylamino group, a sulfonamide group, an acyl group, a sulfo group, a carboxyl group, a sulfamoyl group, a carbamoyl group, an alkoxycarbonyl group, an alkoxysulfonyl group, a sulfonyl group, a halogen atom, a nitro group, a ureido group, a urethane group, a cyano group, an amino group, a hydroxyl group, an acyloxy group, a sulfonyloxy group, a heterocyclic oxy group, a mercapto group or $—CH_2PO_3X_2$ (X being defined as above), $R^1$ and R may join together to form a 5-membered or 6-membered ring such as

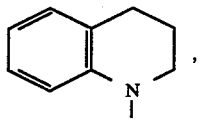

and two of $R^1$, $R^2$, $R^3$, $R^4$ and $R^5$ that are at ortho positions with respect to each other may join to form a 5-membered or 6-membered ring or a spiro ring (e.g., a benzothiazole ring and a chroman ring).

The compounds represented by general formula (II) are described further in detail below. $R^1$, $R^2$, $R^3$, $R^4$ and $R^5$, which may be the same or different, each represents a hydrogen atom, an aliphatic group (e.g., a methyl group, a t-butyl group, a t-octyl group, an allyl group and a benzyl group), an aromatic group (e.g., a phenyl group), a heterocyclic group (e.g., a benzoxazolyl group, and

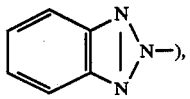

an alkoxy group (e.g., a methoxy group, an i-butoxy group, a cyclohexyloxy group and an n-dodecyloxy group), an aryloxy group (e.g., a phenoxy group, a p-methylphenoxy group, an m-nitrophenoxy group, a 2-chlorophenoxy group and a β-naphthyloxy group), an alkylthio group (e.g., methylthio group, an ethylthio group, a cyclohexylthio group, an i-butylthio group, a phenethylthio group and a tetradecylthio group), an arylthio group (e.g., a phenylthio group and a p-tolylthio group), an alkylamino group (e.g., a methylamino group, an ethylamino group, an N,N-diethylamino group, an N-ethoxymethyl-N-ethylamino group, an n-decylamino group and an N,N-dibenzylamino group), an acylamino group (e.g., an acetamide group, a benzamide group, a butanamide group, a tetradecanamide group, an α-(2,4-di-tert-amylphenoxy)acetamide group, an α-(2,4-di-tert-amylphenoxy)-butylamide group, an N-succinimide group and an N-phthalimide group), a sulfonamide group (e.g., a methanesulfonamide group, a benzenesulfonamide group, a p-tolylsulfonamide group, an N-methyltetradecanesulfonamide group), an acyl group (e.g., an acetyl group, a benzoyl group and a decanoyl group), a sulfo group, a carboxyl group, a sulfamoyl group (e.g., an N-methylsulfamoyl group, N-butylsulfamoyl group, an N,N-dibutylsulfamoyl group and an N-cyclohexylsulfamoyl group), a carbamoyl group (e.g., an N-methylcarbamoyl group, an N-hexylcarbamoyl group, an N,N-dimethylcarbamoyl group and an N-phenylcarbamoyl group), an alkoxycarbonyl group (e.g., a methoxycarbonyl group, a benzyloxycarbonyl group, an n-hexyloxycarbonyl group, a cyclohexyloxycarbonyl group and a decyloxycarbonyl group), an alkoxysulfonyl group (e.g., a methoxysulfonyl group and an octyloxysulfonyl group), a sulfonyl group (e.g., a methanesulfonyl group, a benzenesulfonyl group, a p-(benzyloxy)phenylsulfonyl group and a butanesulfonyl group), a halogen atom (e.g., a chlorine atom, a bromine atom and a fluorine atom), a nitro group, a ureido group, a urethane group, a cyano group, an amino group (e.g., a triazylamino group), a hydroxyl group, an acyloxy group (e.g., an acetyloxy group and a benzoyloxy group), a sulfonyloxy group (e.g., a methanesulfonyloxy group, a butanesulfonyloxy group, a decanesulfonyloxy group and a benzenesulfonyloxy group), a heterocyclic oxy group (e.g., a tetrahydropyranyl group), a mercapto group or $—CH_2PO_3X_2$ (X being defined as above).

Of the compounds represented by general formula (II), preferred are those wherein R represents $—CH_2PO_3X_2$, and more preferred are those represented by the following general formula (III):

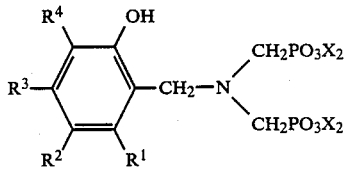

(III)

wherein X, $R^1$, $R^2$, $R^3$ and $R^4$ have the same meaning as defined in general formula (II).

Typical examples of the aromatic compounds having at least one group represented by general formula (I) are shown below, but the present invention is not limited to these compounds.

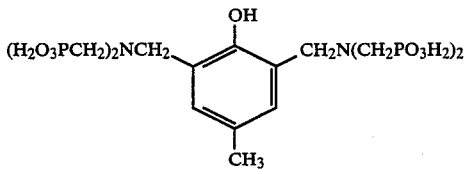

A-1

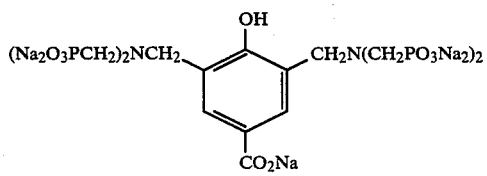

A-2

-continued
A-3
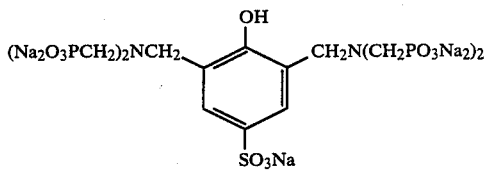
A-4
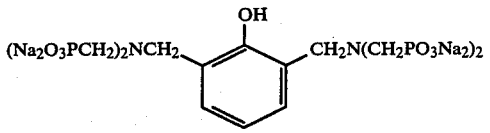
A-5
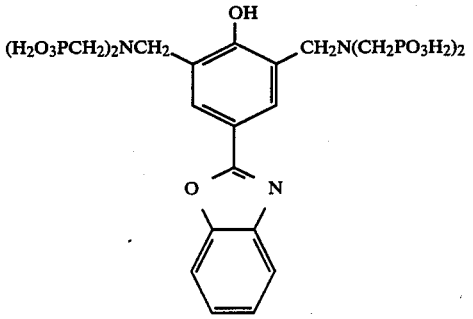
A-6
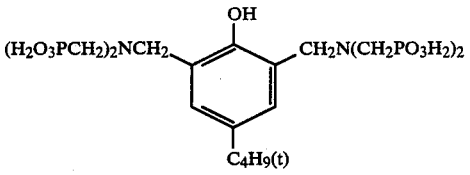
A-7
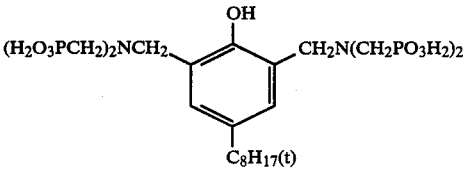
A-8
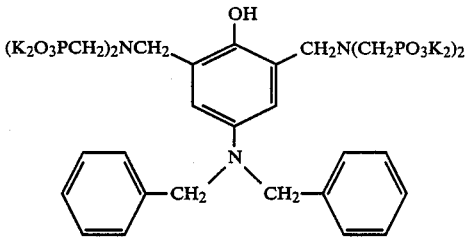
A-9
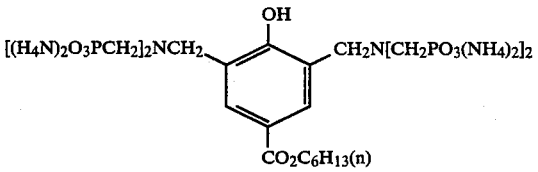
A-10
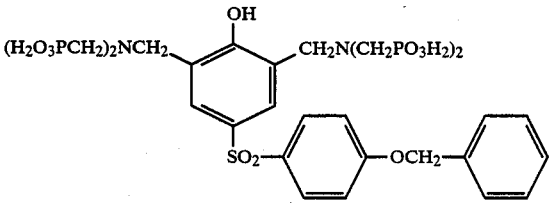

-continued
A-11
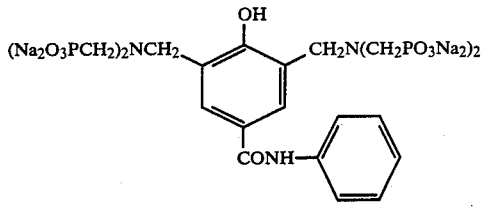
A-12
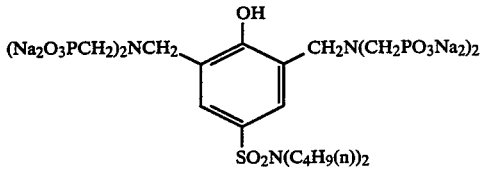
A-13
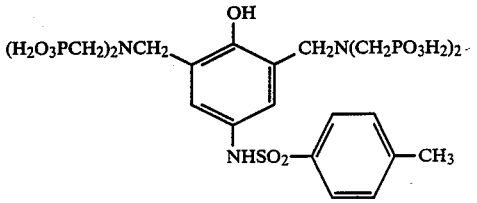
A-14
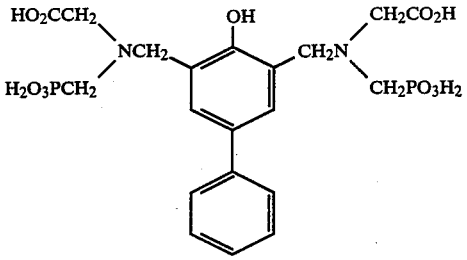
A-15
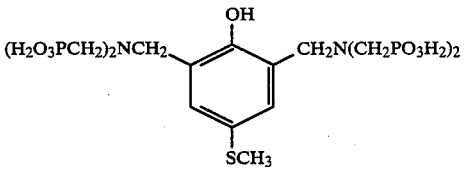
A-16
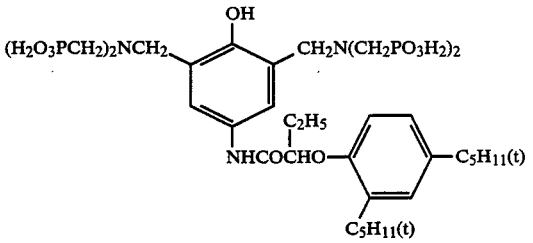
Ca salt of
A-17
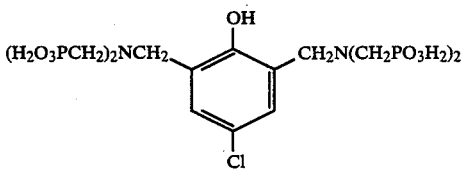
Mg salt of
A-18

-continued
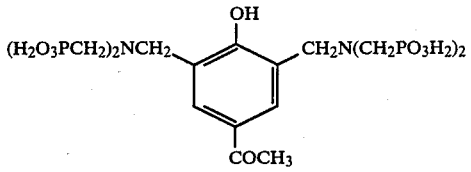
A-19
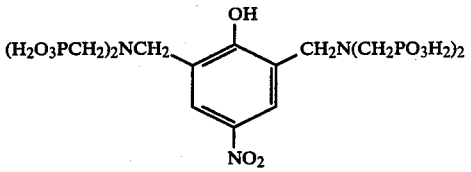
A-20
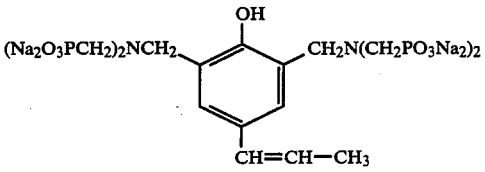
A-21
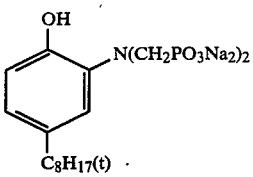
A-22
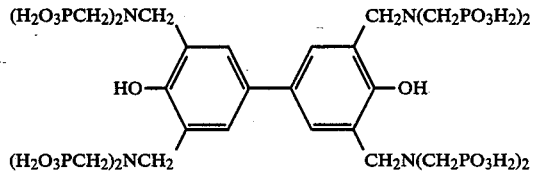
A-23
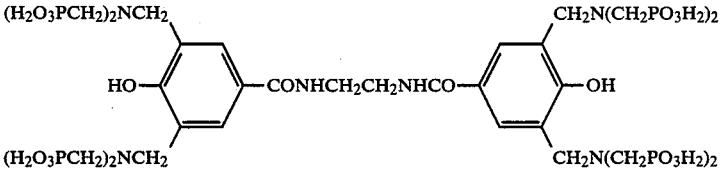
A-24
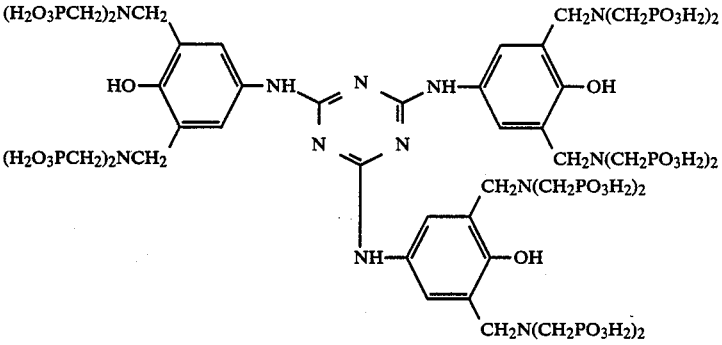
A-25
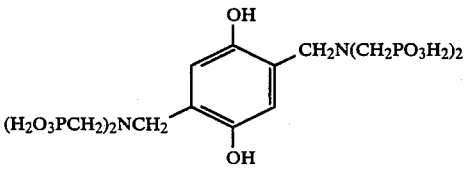

-continued
A-26
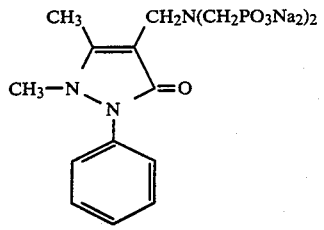
A-27
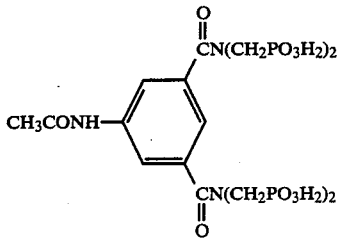
A-28
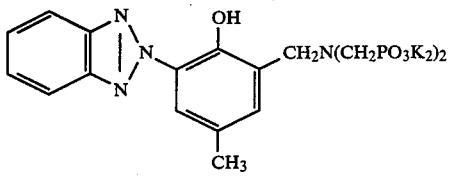
A-29
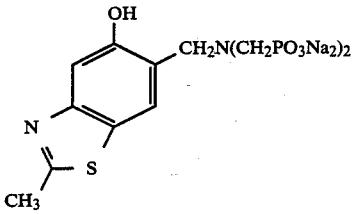
A-30
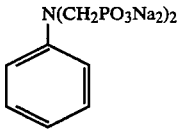
A-31
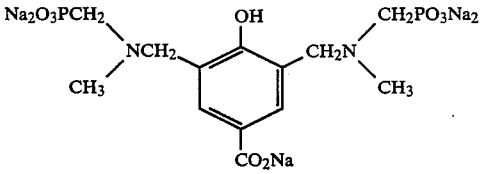
A-32
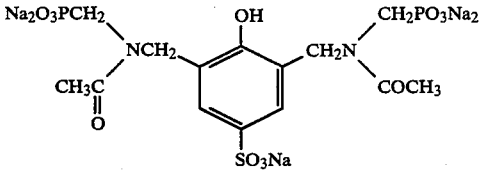
A-33
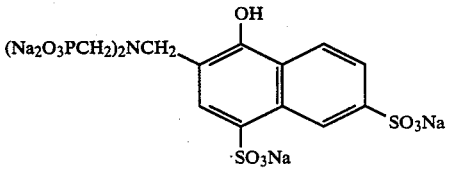

-continued

A-34

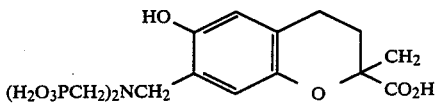

A-35

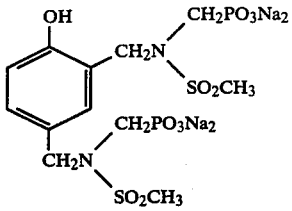

A-36

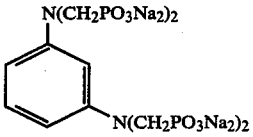

A-37

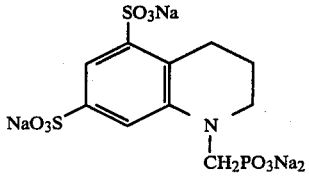

A-38

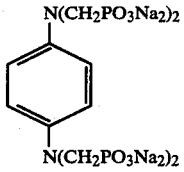

A-39

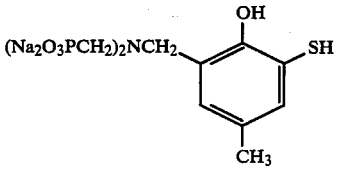

These compounds can be synthesized according to methods described, for example, in British Pat. Nos. 1,230,121 and 1,230,172, German Pat. Nos. 2,013,371, 2,017,974, 2,132,511 and 2,741,504 and U.S. Pat. No. 3,832,393.

Synthesis Examples of typical compounds are given below.

SYNTHESIS EXAMPLE 1

Synthesis of A-7

(i) Synthesis of a Tetracarboxylic Acid:

266 g of iminodiacetic acid and 72 g of paraformaldehyde were added to a mixture of 670 ml of water and 100 ml of ethanol, and an aqueous solution of 160 g of sodium hydroxide dissolved in 330 ml of water was added to the resulting mixture with stirring. After the mixture was heated for 10 minutes under reflux, 137 g of p-tert-octylphenol dissolved in 300 ml of ethanol was added thereto. Then, after the ethanol was removed under normal pressure, the mixture was cooled to room temperature and was allowed to stand for 2 days. The reaction product was poured into 6 liters of water, and then 350 ml of hydrochloric acid was added thereto, whereby crystals were precipitated. The crystals were then filtered and washed with water. After drying the crystals, 283.7 g of a tetracarboxylic acid corresponding to Compound A-7 was obtained. Softening point: 135°–136° C.

(ii) Synthesis of Tetraphosphoric Acid A-7:

60 ml of chlorobenzene was added to 19.7 g of phosphorous acid, and the mixture was heated to 120° C. with stirring while 20 g of the tetracarboxylic acid obtained above was added in portions thereto. After the addition, the reaction product was cooled to a temperature where it became viscous, then 200 ml of acetonitrile was added, and after the mixture was allowed to stand for a while, the supernatant liquid was removed. The residue was dissolved in 150 ml of methanol, and 500 ml of acetone was added for the recrystallization. The solid was filtered, washed with acetone, and dried under vacuum thereby producing 17 g of Compound A-7. Melting point: 200°–207° C.

Elemental Analysis:

| | C | H | N |
|---|---|---|---|
| Found (%) | 35.58 | 6.12 | 4.06 |
| Calculated (%) | 35.72 | 6.00 | 4.17 |

SYNTHESIS EXAMPLE 2

Synthesis of A-16

(i) Synthesis of a Tetracarboxylic Acid:

79.4 g of iminodiacetic acid and 23.9 g of paraformaldehyde were added to a mixture of 140 ml of water and 60 ml of ethanol, and then 47.8 g of sodium hydroxide dissolved in 70 ml of water was added thereto. Thereafter, 81.8 g of 4-[2-(2,4-di-tert-amylphenoxybutanamido)]phenol dissolved in 100 ml of ethanol was dropwise added thereto. The reaction mixture was heated for 3 hours under reflux, then was cooled to room temperature, and was poured to 500 ml of water. After 51 ml of hydrochloric acid was added thereto, the resulting crystals were filtered and washed with water to obtain 55 g of a tetracarboxylic acid corresponding to Compound A-16.

(ii) Synthesis of Tetraphosphoric Acid A-16:

A mixture of 14 g of phosphorous acid and 60 ml of chlorobenzene was heated on a steam bath with stirring while 30 g of the tetracarboxylic acid obtained in Step (i) above was added in portions. After heating for 2 hours, 15 ml of phosphorous trichloride was added dropwise, and the reaction mixture was heated for 3 hours, which resulted in crystallization. After the reaction mixture was cooled to room temperature, 300 ml of acetonitrile was added, and the crystals were filtered, were washed with a solvent mixture of 200 ml of methanol and 200 ml of acetone, and were dried to obtain 29.5 g of Compound A-16. Melting point: 250°-260° C. (decomposition).

Elemental Analysis:

| | C | H | N |
|---|---|---|---|
| Found (%) | 45.32 | 6.59 | 4.88 |
| Calculated (%) | 45.44 | 6.56 | 4.97 |

In the present invention, a processing solution having a bleaching ability refers specifically to a bleaching solution or a bleach-fixing solution.

The complexing agents of the present invention may be used in the form of ferric complex salts or may be used together with a ferric salt such as a ferric sulfate, ferric nitrate, ferric chloride and ferric ammonium sulfate, to form a ferric complex ion in solution. When the complexing agents of the present invention are used in the form of complex salts, one or more of the complex salts may be used. On the other hand, a complexing agent of the present invention and one or more specific ferric salt may be use to form complex salts in solution. Further, one or more of the complexing agents of the present invention may be used. In any case, a complexing agent of the present invention may be used in excess to form a complex salt with a ferric ion.

A ferric complex salt comprising the complexing agent of the present invention may be used together with a known ferric complex salt of aminopolycarboxylic acid. Suitable aminopolycarboxylic acid compounds that can be used together with the complexing agents of the present invention include:

B- 1: Ethylenediaminetetraacetic acid
B- 2: Disodium ethylenediaminetetraacetate
B- 3: Diammonium ethylenediaminetetraacetate
B- 4: Tetra(trimethylammonium) ethylenediaminetetraacetate
B- 5: Tetrapotassium ethylenediaminetetraacetate
B- 6: Tetrasodium ethylenediaminetetraacetate
B- 7: Trisodium ethylenediaminetetraacetate
B- 8: Diethylenetriaminepentaacetic acid
B- 9: Pentasodium diethylenetriaminepentaacetate
B-10: Ethylenediamine-N-(β-oxyethyl)-N,N',N'-triacetic acid
B-11: Trisodium ethylenediamine-N-(β-oxyethyl)-N,N',N'-triacetate
B-12: Triammonium ethylenediamine-N-(β-oxyethyl)-N,N',N'-triacetate
B-13: 1,2-Propylenediaminetetraacetic acid
B-14: Disodium 1,2-propylenediaminetetraacetic acid
B-15: Nitrilotriacetic acid
B-16: Trisodium nitrilotriacetate
B-17: Cyclohexanediaminetetraacetic acid
B-18: Disodium cyclohexanediaminetetraacetate
B-19: Iminodiacetic acid
B-20: Dihydroxyethylglycine
B-21: Ethyl ether diaminetetraacetic acid
B-22: Glycol ether diaminetetraacetic acid
B-23: Ethylenediaminetetrapropionic acid
B-24: 1,3-Diaminopropanetetraacetic acid
B-25: 1,4-Diaminobutanetetraacetic acid One of ferric complex salts of the present invention and one of aminopolycarboxylic acid ferric complex salts may be combined, or two or more of the ferric complex salts and two or more of aminopolycarboxylic acid ferric complex salts may be combined in the processing solution having a bleaching ability, if desired.

A ferric complex salt of the present complexing agents and the above aminopolycarboxylic acid compound may also be used in combination.

When the complexing agents of the present invention and the above-described aminopolycarboxylic acid compounds are used in combination, preferably the molar ratio is from about 1/10 to about 10/1, more preferably from 1/5 to 5/1.

Preferably, the total amount of the ferric complex salts per liter of the present processing solution having a bleaching ability is from about 0.1 to about 1 mol, more preferably from 0.2 to 0.5 mol.

A compound known as a fixing agent can be added to the present processing solution having a bleaching ability. For example, suitable fixing agents include thiosulfates such as sodium thiosulfate, ammonium thiosulfate, sodium ammonium thiosulfate and potassium thiosulfate, thiocyanates such as sodium thiocyanate, ammonium thiocyanate and potassium thiocyanate, thiourea an thioethers. The amount of these fixing agents to be added is preferably about 3 mol or below, more preferably from 0.5 to 2 mol, per liter.

A compound conventionally known as a bleaching accelerator can also be added to the present processing solution having a bleaching ability. Suitable bleaching accelerators include, for example, compounds having a disulfide group or a mercapto group described, for example, in U.S. Pat. No. 3,893,858, German Pat. No. 1,290,812, Japanese patent application (OPI) No. 95630/78 and *Research Disclosure*, No. 171129 (July, 1978), thiazolidine compounds described in Japanese patent application (OPI) No. 140129/75, thiourea derivatives described in U.S. Pat. No. 3,706,561, iodides described in Japanese patent application (OPI) No. 16235/83, polyethylene oxides described in German Pat. No. 2,748,430 and polyamine compounds described in Japanese Patent Publication No. 8836/70. Particularly preferred are compounds described in Japanese patent application (OPI) No. 75352/86. These bleaching accelerators can also be added to a bath preceding the present processing solution having a bleaching ability, if desired.

In addition to the bleaching agent and the compounds mentioned above, the present processing solution having a bleaching ability can contain rehalogenating agents, for example, bromides such as potassium bromide, sodium bromide and ammonium bromide and chlorides such as potassium chloride, sodium chloride and ammonium chloride. Further, other additives that have a pH buffering ability and are known to be used generally in a bleaching solution can be used, and, for example, one or more inorganic acids, organic acids and their salts such as nitrates (e.g., sodium nitrate and ammonium nitrate), boric acid, borax, sodium metaborate, acetic acid, sodium acetate, sodium carbonate, potassium carbonate, phosphorous acid, phosphoric acid, sodium phosphate, citric acid, sodium citrate and tartaric acid can be added to the solution.

Further, other conventional additives that can be added to bleach-fixing solution (such as sulfites, bisulfites, various buffering agents and chelating agents) can be added, if desired.

The pH of the present processing solution having a bleaching ability is preferably from about 4.0 to about 8.0.

The present processing solution having a bleaching ability may be used in practice as a bleaching bath or a bleach-fixing bath.

The present processing solution having a bleaching ability may be used as a bleaching/bleach-fixing bath as described in Japanese patent application (OPI) No. 75352/86. The present processing bath having a bleaching ability may be placed just after a color developing bath, or a washing bath or an intermediate bath may be placed between them.

Although the processing temperature and the processing time required for processing color photographic materials using the present processing solution having a bleaching ability depend on the type of photographic material, the processing solution composition, etc., preferably the processing temperature and the processing time are generally from about 20° to about 60° C. and about 6 minutes or less, respectively.

In the present processing method, the color developing solution used is preferably an aqueous alkaline solution containing as a major component an aromatic primary amine type color developing agent. As this color developing agent, p-phenylenediamine type compounds are preferably employed. Typical examples of p-phenylenediamine type compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline and their sulfates, hydrochlorides, phosphates or p-toluenesulfonates or tetraphenylborates and p-(t-octyl)benzenesulfonates.

The concentration of the developing agent in the color developing solution and the pH of the color developing solution are very important factors as to shortening the color development time. Thus, in the present invention, the developing agent is used in a concentration of about 1.0 g to about 15 g, preferably 3.0 g to 8.0 g, per liter of the color developing solution. Generally, the pH of the color developing solution is about 9 or higher, most preferably from 9.5 to 12.0.

Preferably, the processing temperature of the color developing solution in the present processing method is from about 20° to about 50° C.

In the present invention, when required, various development accelerators can be additionally used.

Suitable development accelerators include benzyl alcohol, various pyrimidium compounds as described, for example, in U.S. Pat. No. 2,648,604, Japanese Patent Publication No. 9503/69 and U.S. Pat. No. 3,171,247, other cationic compounds, cationic dyes such as phenosafranine, neutral salts such as thallium nitrate and potassium nitrate, nonionic compounds such as polyethylene glycols, their derivatives and polythioethers described in Japanese Patent Publication No. 9304/69, U.S. Pat. Nos. 2,533,990, 2,531,832, 2,950,970 and 2,577,127 and thioether type compounds described in U.S. Pat. No. 3,201,242.

In the color developing step in the present processing method, various antifoggants can additionally be used for the purpose of preventing development fog. Suitable antifoggants in the developing step include an alkali metal halide such as potassium bromide, sodium bromide and potassium iodide and an organic antifoggant. Suitable organic antifoggants include, for example, nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole and hydroxyazaindolizine, mercapto-substituted heterocyclic compounds such as 1-phenyl-5-mercaptotetrazole, 2-mercaptobenzimidazole and 2-mercaptobenzothiazole and mercapto-substituted aromatic compounds such as thiosalicylic acid. These antifoggants include antifoggants that can dissolve from the color photographic material into the developing solution during processing.

Further, the color developing solution in the present processing method can contain pH buffering agents such as carbonates, borates and phosphates of alkali metals; preservatives such as hydroxylamine, triethanolamine, bisulfates, sulfites and compounds described in West German patent application (OLS) No. 2,622,950; organic solvents such as diethylene glycol; dye forming couplers; competing couplers such as citrazinic acid, J-acid and H-acid; nucleating agents such as sodium boron hydride; auxiliary developers such as 1-phenyl-3-pyrazolidone; thickening agents; ethylenediaminetetraacetic acid, nitrilotriacetic acid, cyclohexanediaminetetraacetic acid, iminodiacetic acid, N-hydroxymethyl-ethylenediaminetriacetic acid, diethylenetriaminepentaacetic acid, triethylenetetraminehexaacetic acid, 1-hydroxyethylidene-1,1'-diphosphonic acid and aminopolycarboxylic acids such as the compounds described in Japanese patent application (OPI) No. 195845/83, organic phosphonic acids described in *Research Disclosure*, No. 18170 (May, 1979), aminophosphonic acids such as ethylenediamine-N,N,N', N'-tetramethylenephosphonic acid, aminotris(methylenephosphonic acid) and chelating agents such as phosphonocarboxylic acids described in Japanese patent application (OPI) Nos. 102726/77, 42730/78, 121127/79, 4024/80, 4025/80, 126241/80, 65955/80 and 65956/80 and *Research Disclosure*, No. 18170 (May, 1979).

If required, the color developing bath may be divided into two or more baths, so that a color developing replenisher may be supplied from the first bath or the last bath to shorten the developing time or to reduce the amount of the replenisher.

The present processing method can be used in a color reversal process. A suitable black-and-white developing solution used in this case includes one known as a black-and-white first developing solution (used in reversal process of color photographic materials), or one that can be used in processing black-and-white photographic materials. Further, known various additives that are generally added to a black-and-white developing solution can be obtained in the solution.

Such typical additives include developing agents such as hydroquinone, 1-phenyl-3-pyrazolidone and Metol (monomethyl-p-aminophenol sulfate), preservatives such as sulfites, accelerators comprising an alkali such as sodium hydroxide, sodium carbonate and potassium carbonate, inorganic or organic restrainers such as methylbenzothiazole, 2-methylbenzimidazole and potassium bromide, water softeners such as polyphosphates and development restrainers comprising trace amounts of iodides or mercapto compounds.

The present processing method comprises processing steps including color development, bleaching, bleach-fixing, etc., as mentioned before. After the bleach-fixing step, although processing steps that include washing and stabilizing are generally carried out, a simple processing method is also possible wherein after bleach-fixing, a stabilizing process is carried out without performing substantial washing.

The washing water used in the washing step can contain, if required, known additives. For example, water softeners such as inorganic phosphoric acid, aminopolycarboxylic acids and organic phosphoric acids, fungicides and mildewcides for preventing bacteria and algae from proliferating (e.g., isothiazolone, organic chlorine type fungicides and benzotriazole) and surface active agents for lowering drying load or for preventing uneven drying can be used. Compounds described, for example, by L. E. West in "Water Quality Criteria", *Phot. Sci. and Eng.*, Vol. 9, No. 6, pages 344 to 359 (1965) can also be used.

The washing step can be performed using, if required, two or more tanks, and a multistage countercurrent washing (e.g., a 2- to 9-stage countercurrent washing) can be used to reduce the amount of washing water required (e.g., to 1 liter/$m^2$ or below).

A suitable stabilizing solution used in the stabilizing step includes a processing solution for stabilizing dye images. For example, a liquid having a pH of 3 to 6 and a buffering ability and a liquid containing an aldehyde (e.g., formalin) can be used. The stabilizing solution can include, if required, ammonium compounds or compounds of metals such as Bi and Al, brightening agents, chelating agents (e.g., 1-hydroxyethylidene-1,1-diphosphonic acid), fungicides, mildewcides, hardening agents, surface active agents, etc.

If required, the stabilizing step can be carried out using two or more baths or a multistage (e.g., 2- to 9-stage) countercurrent stabilizing to reduce the amount of stabilizing solution (e.g., to reduce to 1 liter/$m^2$ or below) or to omit the water washing step.

Water suitable for use in the washing step or the stabilizing step includes tap water, water that has been deionized, for example, by ion exchange resins to reduce Ca/Mg concentrations to 5 mg/liter or below, or water that has been sterilized, for example, by a halogen or a bactericidal ultraviolet lamp.

The present invention can be applied to various color photographic materials, and typical examples thereof are color negative film for filming, color negative films for slides or television, color papers, color positive films and color reversal papers.

The silver halide emulsions used in the color photographic materials to be processed in the present invention can be prepared by using a method described in *Research Disclosure*, Vol. 176, No. 17643, § [I].

Such silver halide emulsions may comprise any of silver bromide, silver bromoiodide, silver bromochloroiodide, silver chlorobromide and silver chloride.

The silver halide emulsion is generally coated in an Ag amount of 0.5 g/$m^2$ or more, and particularly preferably 1.0 g/$m^2$ or more.

The silver halide grains in the photographic emulsion may be so-called regular grains having regular crystal forms such as cubes, octahedrons or tetradecahedrons, or may have an irregular crystal shape such as spherical crystals, crystals having crystal defects such as twin planes or composites of these.

The silver halide may be fine grains having a grain diameter of up to about 0.1 micron or coarse grains wherein the diameter of the projected area is up to about 10 microns, and a monodispersed emulsion having a narrow distribution or a polydispersed emulsion having a wide dispersion can be used.

A typical monodispersed emulsion is one wherein the average grain diameter of the silver halide grains is greater than about 0.1 micron and at least about 95 wt % of the silver halide grains are within ±40% of the average grain diameter. In the present invention, an emulsion can be used wherein the average grain diameter is about 0.25 to 2 microns, and at least about 95% by weight or at least about 95% by number of the silver halide grains are within the average particle diameter ±20%.

The crystal structure may be uniform, or the outer part of the halogen composition may be different from the inner part thereof, or may have a layer structure. These types of emulsion grains are disclosed, for example, in British Pat. No. 1,027,146, U.S. Pat. Nos. 3,505,068 and 4,444,877 and Japanese patent application (OPI) No. 143331/85. Silver halides different in composition may be joined by epitaxial conjunction.

When tabular grains are used in the silver halide photographic emulsions used in the present invention, improvements in sensitivity (including the improvement in color sensitizing effect by sensitizing dyes), improvements in the relationship between sensitivity and graininess, improvements in sharpness, improvements in covering power and improvements in crossover, can be attained. Herein, the term "tabular silver halide grains" refers to tabular silver halide grains whose diameter/thickness ratio is about 5 or higher, and, for example, tabular silver halide grains having a diameter/thickness ratio of from 8 to 20 are preferred.

Preferably, the tabular grain halogen composition is one of silver bromide, silver bromoiodide, silver bromochloride, silver bromochloroiodide, silver chloroiodide or silver chloride. For highly sensitive photographic materials, silver bromoiodide is particularly preferably used. In the case of using silver bromoiodide, the content of silver iodide is generally from about 1 to about 40 mol %, preferably from 3 to 20 mol %, and more preferably up to 15 mol %. For photographic materials used for printing, silver chlorobromide and silver bromide are particularly preferred.

Tabular grains may comprise a uniform halogen composition or may be composed of two or more phases having different halogen compositions. For example, when silver bromoiodide is used, the silver bromoiodide tabular grains may have a structure with layers different in their iodide content. Preferred examples of the halogen composition of tabular silver halide grains and the distribution of the halogens in the grains are described, for example, in Japanese patent application (OPI) Nos. 113928/83 and 99433/84.

Preferred methods of using tabular silver halide grains in the present invention are described in detail in *Research Disclosure,* No. 22534 (January, 1983) and *Research Disclosure,* No. 25330 (May, 1985), in which, for example, a method of using tabular silver halide grains based on the relationship between the thickness of the tabular silver halide grains and the optical properties thereof is disclosed.

To facilitate ripening of the formation of silver halide grains, it is useful to use a silver halide solvent. For example, to facilitate ripening, it is known to allow an excess of halogen ions to be present in the reactor. Ripening agents other than halogen ions that can be used are ammonia, amine compounds, and thiocyanates such as alkali metal thiocyanates, particularly sodium and potassium thiocyanates, and ammonium thiocyanate. The use of thiocyanate ripening agents is taught in U.S. Pat. Nos. 2,222,264, 2,448,534 and 3,320,069. Commonly used thioether ripening agents described in U.S. Pat. Nos. 3,271,157, 3,574,628 and 3,737,313 can also be used. Further, thione compounds disclosed in Japanese patent application (OPI) Nos. 82408/78 and 144319/78 can be employed.

By permitting various compounds to be present during the formation of a silver halide precipitate, the resulting properties of the silver halide grains can be controlled. For example, by permitting a compound of copper, iridium, lead, bismuth, cadmium, zinc (including chalcogen compounds such as sulfur, selenium and tellurium compounds), gold and Group VIII noble metals, the properties of silver halide can be controlled.

Generally, the silver halide emulsions are chemically sensitized. Chemical sensitization can be effected by using active gelatin as described by T. H. James in *The Theory of the Photographic Process,* 4th Edition, Macmillan, 1977, pages 67–76. Sulfur, selenium, tellurium, gold, platinum, palladium or iridium, or a combination of two or more of these sensitizers, can be used. Most suitably, chemical sensitization is carried out in the presence of a gold compound and a thiocyanate compound or in the presence of a rhodanine type compound, a thiourea type compound, sodium thiosulfate or a sulfur-containing compound described in U.S. Pat. Nos. 3,857,711, 4,266,018 and 4,054,457. Chemical sensitization can also be carried out in the presence of a chemical sensitization assistant. Suitable chemical sensitization assistants that can be used are compounds that are known to increase sensitivity and suppress fog formation in the course of the chemical sensitization such as azaindene, azapyridazine and azapyrimidine.

The silver halide photographic emulsion used in the present invention may be spectrally sensitized with a methine dye or the like. Sensitizing dyes that can be used include cyanine dyes, merocyanine dyes, composite cyanine dyes, composite merocyanine dyes, holopolar cyanine dyes, hemicyanine dyes, styryl dyes and hemioxonol dyes. Preferred sensitizing dyes are those falling into the categories of cyanine dyes, merocyanine dyes and composite merocyanine dyes.

These sensitizing dyes may be used alone or in combination, and when they are used in combination, they are often used for the purpose of supersensitization. In addition to a sensitizing dye, the emulsion may contain a dye that does not have a spectral sensitizing effect itself, or a material that does not absorb substantially visible light, but exhibits a supersensitizing effect.

Examples of such dyes are those described in *Research Disclosure,* Vol. 176, No. 17643, § IV (December, 1978).

The spectral sensitization of the silver halide emulsions used in the prsent invention can be carried out during any stage of preparation of the emulsion.

Generally, however, a spectral sensitizing dye is added to the chemically sensitized emulsion before coating. For example, U.S. Pat. No. 4,425,426 discloses a method wherein a sensitizing dye is added to an emulsion before or during the chemical sensitization. Further, U.S. Pat. Nos. 2,735,766, 3,628,960, 4,183,756 and 4,225,666 disclose methods wherein a spectral sensitizing dye is added to an emulsion before the completion of the formation of silver halide grains. In particular, U.S. Pat. Nos. 4,183,756 and 4,225,666 disclose that it is advantageous to add a spectral sensitizing dye to an emulsion after the formation of stable nuclei for the formation of silver halide grains, since the photographic sensitivity is increased and the adsorption of the spectral sensitizing dye onto the silver halide grains is enhanced.

For the purpose of increasing the sensitivity and the contrast or to facilitate development, the photographic emulsion layer of the present photographic materials may contain, for example, polyalkylene oxides or their derivatives such as their ethers, esters and amines, thioether compounds, thiomorpholines, quaternary ammonium salt compounds, urethane derivatives, urea derivatives, imidazole derivatives and 3-pyrazolidones.

The silver halide photographic emulsions used in the present invention may also contain various compounds for the purpose of preventing the photographic materials from fogging in the process of the preparation thereof or during the storage thereof, or during photographic processing, or for the purpose of stabilizing the photographic performance. That is, various compounds known as stabilizers or antifoggants can be added, for example, azoles such as benzothiazoliums, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles and mercaptotetrazoles (particularly, 1-phenyl-5-mercaptotetrazole); mercaptopyrimidines; mercaptotriazines; thioketo compounds such as oxazolinethione; azaindenes such as triazaindenes, tetraazaindenes (particularly, 4-hydroxy-substituted (1,3,3a,7)tetraazaindenes) and pentaazaindenes; benzenethiosulfonic acid, benzenesulfinic acid and benzenesulfonic acid amide.

In the photographic materials to be processed in accordance with the present invention, various couplers can be used, and examples thereof are described in the patents cited in *Research Disclosure* (RD), No. 17643, § VII-C-G. Important dye forming couplers include couplers that give rise to the three primary colors (that is, yellow, magenta and cyan) of the subtractive color process by color development, and examples of non-diffusible 4-equivalent or 2-equivalent couplers include those described in the patents cited in *Research Disclosure*, No. 17643, §§ VII-C and D. Also, those couplers described below can also be preferably used.

Typical examples of yellow couplers that can be used include known oxygen atom-leaving type yellow couplers or nitrogen atom-leaving type yellow couplers. α-Pivaloylacetanilide type couplers are excellent in fastness, particularly light fastness, of the developed dyes, while α-benzoylacetanilide type couplers give a high color density.

Magenta couplers that can be used in the present invention include hydrophobic 5-pyrazolone type and pyrazoloazole type couplers having a ballasting group. Of these 5-pyrazolone type couplers, couplers wherein the 3-position is substituted by an arylamino group or an acylamino group are preferred in view of the resulting color density and the hue of the developed dye.

Typical examples of cyan couplers that can be used in the present invention include hydrophobic and nondiffusible naphthol type and phenol type couplers, preferably oxygen-leaving type 2-equivalent naphthol type couplers. Couplers capable of forming cyan dyes fast to humidity and temperature are preferably used, and typical examples thereof are phenol type couplers having an acylamino group at the 5-position and a phenylureido group at the 2-position, 2,5-diacylaminosubstituted phenol type couplers and phenol type cyan couplers having an alkyl group higher than a methyl group at the meta-position of the phenol nucleus described in U.S. Pat. No. 3,772,002 and 5-amidonaphthol type cyan couplers described in European Pat. No. 161,626A.

Couplers whose developed dyes are diffusible can also be additionally used to improve the graininess. Specific examples of such couplers are the magenta couplers described, for example, in U.S. Pat. No. 4,366,237 and the yellow, magenta and cyan couplers described, for example, in European Pat. No. 96,570.

Dye forming couplers and the above special couplers may be in the form of dimers or higher polymers. Typical examples of dye forming couplers that are polymerized are described, for example, in U.S. Pat. No. 3,451,820. Specific examples of polymerized magenta couplers are described, for example, in U.S. Pat. No. 4,367,282.

Couplers that will release a photographically useful residue upon the coupling reaction can also preferably be used in the present invention. Useful DIR couplers that will release a development restrainer are the couplers described in the patents cited in *Research Disclosure*, No. 17643, § VII-F.

In the present photographic materials, couplers can be used that will imagewise release a nucleating agent or a development accelerator or its precursor when developed. Specific examples of such compounds are described in British Pat. Nos. 2,097,140 and 2,131,188. Also, for example, DIR redox compound-releasing couplers described, for example, in Japanese patent application (OPI) No. 185950/85 and couplers which can release a dye that will restore color after the separation described in European Pat. No. 173,302A, can be used.

Couplers that are used in the present invention can be incorporated into a photographic material by any one of various known dispersion methods. Examples of high boiling point organic solvents used in the oil-in-water dispersion method are described, for example, in U.S. Pat. No. 2,322,027. The latex dispersion method, the effect thereof, and specific examples of latexes for impregnation are described, for example, in U.S. Pat. No. 4,199,363, West German patent application (OLS) Nos. 2,541,274 and 2,541,230.

The photographic materials used in the present invention may contain, as color fogging preventive agents or color mixing preventive agents, hydroquinone derivatives, aminophenol derivatives, amines, gallic acid derivatives, catechol derivatives, ascorbic acid derivatives, colorless couplers and sulfonamidophenol derivatives.

The photographic materials used in the present invention can also contain known discoloration preventive agents. Typical examples of such discoloration preventive agents are hydroquinones, 6-hydroxychromans, 5-hydroxychromans, spirochromans, p-alkoxyphenols, hindered phenols including bisphenols, gallic acid derivatives, methylenedioxybenzenes, aminophenols, hindered amines and ether or ester derivatives wherein the phenolic hydroxyl group of these compounds is silylated or alkylated. Metal complexes such as (bis-salicylaldoxymato)nickel complex and (bis-N,N-dialkyldithiocarbamato)nickel complexes can also be used.

In the photographic materials used in the present invention, an ultraviolet absorbing agent can be added into a hydrophilic colloid layer. For example, aryl group-substituted benzotriazoles described, for example, in U.S. Pat. No. 3,553,794 and European Pat. No. 57,160, butadienes described in U.S. Pat. No. 4,450,229, cinnamic acid esters described in U.S. Pat. No. 3,705,805, benzophenones described in U.S. Pat. No. 3,215,530 and polymer compounds having an ultraviolet absorbing residue as described in U.S. Pat No. 3,761,272, can be employed. Ultraviolet absorbing brightening agents described in U.S. Pat. No. 3,499,762 may also be used. Typical examples of ultraviolet absorbing agents are described in *Research Disclosure*, No. 24239 (June, 1984).

The photographic materials used in the present invention may contain one or more surface active agents as coating assistants, as antistatic agents, or for the purposes of improving the slipping characteristics, the emulsification/dispersion ability and the photographic characteristics (e.g., acceleration of development, sensitization and high contrast property), for the purpose of preventing adhesion and for other purposes.

The photographic materials used in the present invention may contain water-soluble dyes in a hydrophilic colloid layer as filter dyes or for the purpose of preventing irradiation or halation, or for other purposes. Preferred examples of such dyes are oxonol dyes, hemioxonol dyes, styryl dyes, merocyanine dyes, anthraquinone dyes and azo dyes, and cyanine dyes, azomethine dyes, triazolemethane dyes and phthalocyanine dyes can also be used. Oil-soluble dyes can be emulsified by the oil-in-water dispersion method to be added to the hydrophilic colloid layer.

In the photographic materials used in the present invention, in order to introduce a lipophilic compound (such as photographic couplers) into a hydrophilic organic colloid layer, various methods can be used, such as the oil-in-water dispersion method, the latex dispersion method, the solid dispersion method and the alkali dispersion method. A preferred method can be suitably selected depending on the chemical structure and the physicochemical properties of the compound to be incorporated therein.

The present invention will now be explained in detail with reference to the following examples, which are given for the purpose of illustration only and not meant to limit the invention. Unless otherwise indicated, all parts, percents, ratios and the like are by weight.

EXAMPLE 1

A cellulose triacetate film base coated with a subbing layer was then coated with layers each having the following composition to prepare a multilayer color photographic material, Sample 101.

Photographic Layer Composition

The number for each component is the coating amount in g/m$^2$, and for silver halides, the coating amount is in terms of silver. As for sensitizing dyes and couplers, the coating amount is in mols per 1 mol of the silver halide in the same layer.

| Sample 101 | |
|---|---|
| A First Layer: An Antihalation Layer | |
| Black colloidal silver | 0.18 (silver) |
| Gelatin | 0.40 |
| A Second Layer: An Intermediate Layer | |
| 2,5-Di-t-pentadecylhydroquinone | 0.18 |
| Coupler C-1 | 0.07 |
| Coupler C-3 | 0.02 |
| Ultraviolet Absorber U-1 | 0.08 |
| Ultraviolet Absorber U-2 | 0.08 |
| High Boiling Point Organic Solvent HBS-1 | 0.10 |
| High Boiling Point Organic Solvent HBS-2 | 0.02 |
| Gelatin | 1.04 |
| A Third Layer: A First Red-Sensitive Emulsion Layer | |
| Silver bromoiodide emulsion (silver iodide: 6 mol %, average grain diameter: 0.8 μm) | 0.50 (silver) |
| Sensitizing Dye VIII | $6.9 \times 10^{-5}$ |
| Sensitizing Dye I | $1.8 \times 10^{-5}$ |
| Sensitizing Dye II | $3.1 \times 10^{-4}$ |
| Sensitizing Dye III | $4.0 \times 10^{-5}$ |
| Coupler C-2 | 0.146 |
| High Boiling Point Organic Solvent HBS-1 | 0.40 |
| Coupler C-10 | 0.008 |
| Gelatin | 1.20 |
| A Fourth Layer: A Second Red-Sensitive Emulsion Layer | |
| Silver bromoiodide emulsion (silver iodide: 5 mol %, average grain diameter: 0.85 μm) | 1.15 (silver) |
| Sensitizing Dye VIII | $5.1 \times 10^{-5}$ |
| Sensitizing Dye I | $1.4 \times 10^{-5}$ |
| Sensitizing Dye II | $2.3 \times 10^{-5}$ |
| Sensitizing Dye III | $3.0 \times 10^{-5}$ |
| Coupler C-2 | 0.060 |
| Coupler C-3 | 0.008 |
| Coupler C-10 | 0.004 |
| High Boiling Point Organic Solvent HBS-2 | 0.40 |
| Gelatin | 1.50 |
| A Fifth Layer: A Third Red-Sensitive Emulsion Layer | |
| Silver bromoiodide emulsion (silver iodide: 10 mol %, average grain diameter: 1.5 μm) | 1.50 (silver) |
| Sensitizing Dye VIII | $5.4 \times 10^{-5}$ |
| Sensitizing Dye I | $1.4 \times 10^{-5}$ |
| Sensitizing Dye II | $2.4 \times 10^{-4}$ |
| Sensitizing Dye III | $3.1 \times 10^{-5}$ |
| Coupler C-5 | 0.012 |
| Coupler C-3 | 0.003 |
| Coupler C-4 | 0.004 |
| High Boiling Point Organic Solvent HBS-1 | 0.32 |
| Gelatin | 1.63 |
| A Sixth Layer: An Intermediate Layer | |
| Gelatin | 1.06 |
| A Seventh Layer: | |
| A First Green-Sensitive Emulsion Layer | |
| Silver bromoiodide emulsion (silver iodide: 6 mol %, average grain diameter 0.8 μm) | 0.35 (silver) |
| Sensitizing Dye IV | $3.0 \times 10^{-5}$ |
| Sensitizing Dye V | $1.0 \times 10^{-4}$ |
| Sensitizing Dye VI | $3.8 \times 10^{-4}$ |
| Coupler C-6 | 0.120 |
| Coupler C-1 | 0.021 |
| Coupler C-7 | 0.030 |
| Coupler C-8 | 0.025 |
| High Boiling Point Organic Solvent HBS-1 | 0.20 |
| Gelatin | 0.70 |
| An *Eighth Layer: | |
| A Second Green-Sensitive Emulsion Layer | |
| Silver bromoiodide emulsion (silver iodide: 5 mol %, average grain diameter 0.85 μm) | 0.75 (silver) |
| Sensitizing Dye IV | $2.1 \times 10^{-5}$ |
| Sensitizing Dye V | $7.0 \times 10^{-5}$ |
| Sensitizing Dye VI | $2.6 \times 10^{-4}$ |
| Coupler C-6 | 0.021 |
| Coupler C-8 | 0.004 |
| Coupler C-1 | 0.002 |
| Coupler C-7 | 0.003 |
| High Boiling Point Organic Solvent HBS-1 | 0.15 |
| Gelatin | 0.80 |
| A Ninth Layer: A Third Green-Sensitive Emulsion Layer | |
| Silver bromoiodide emulsion (silver iodide: 10 mol %, average grain size: 1.2 μm) | 1.80 (silver) |
| Sensitizing Dye IV | $3.5 \times 10^{-5}$ |
| Sensitizing Dye V | $8.0 \times 10^{-5}$ |
| Sensitizing Dye VI | $3.0 \times 10^{-4}$ |
| Coupler C-6 | 0.011 |
| Coupler C-1 | 0.001 |
| High Boiling Point Organic Solvent HBS-2 | 0.69 |
| Gelatin | 1.74 |
| A Tenth Layer: A Yellow Filter Layer | |
| Yellow colloidal silver | 0.05 (silver) |
| 2,5-Di-t-pentadecylhydroquinone | 0.03 |
| Gelatin | 0.95 |
| An Eleventh Layer: | |
| A First Blue-Sensitive Emulsion Layer | |
| Silver bromoiodide emulsion (silver iodide 6 mol %, average grain diameter: 0.6 μm) | 0.24 (silver) |
| Sensitizing Dye VII | $3.5 \times 10^{-4}$ |
| Coupler C-9 | 0.27 |
| Coupler C-8 | 0.005 |
| High Boiling Point Organic Solvent HBS-1 | 0.28 |
| Gelatin | 1.28 |
| A Twelfth Layer: | |
| A Second Blue-Sensitive Emulsion Layer | |
| Silver bromoiodide emulsion (silver iodide: 10 mol %, average grain diameter: 1.0 μm) | 0.45 (silver) |
| Sensitizing Dye VII | $2.1 \times 10^{-4}$ |
| Coupler C-9 | 0.098 |
| High Boiling Point Organic Solvent HBS-1 | 0.03 |
| Gelatin | 0.46 |
| A Thirteenth Layer: A Third Blue-Sensitive Emulsion Layer | |
| Silver bromoiodide emulsion (silver iodide: 10 mol %, average grain diameter: 1.8 μm) | 0.77 (silver) |
| Sensitizing Dye VII | $2.2 \times 10^{-4}$ |
| Coupler C-9 | 0.036 |
| High Boiling Point Organic Solvent HBS-1 | 0.07 |
| Gelatin | 0.69 |
| A Fourteenth Layer: A First Protective Layer | |
| Silver bromoiodide (silver iodide: 1 mol %, average grain diameter: 0.07 μm) | 0.5 (silver) |
| Ultraviolet Absorber U-1 | 0.11 |
| Ultraviolet Absorber U-2 | 0.17 |
| High Boiling Point Organic Solvent | 0.90 |

-continued

| Sample 101 | |
|---|---|
| HBS-1 | |
| Gelatin | 0.95 |
| A Fifteenth Layer: A Second Protective Layer | |
| Polymethyl methacrylate particles (average diameter: about 1.5 μm) | 0.54 |
| S-1 | 0.15 |
| S-2 | 0.05 |

-continued

| Sample 101 | |
|---|---|
| Gelatin | 0.72 |

To each layer, in addition to the above components, was added Gelatin Hardening Agent H-1 and surface active agents.

Chemical formulae or chemical names of the compounds used in the above Sample 101 are given below:

U-1

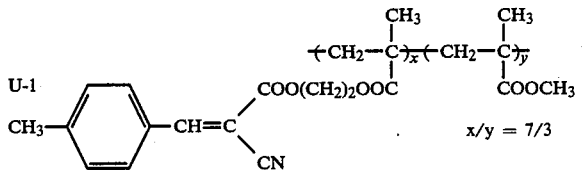

U-2

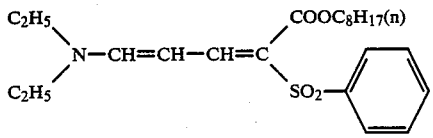

C-1

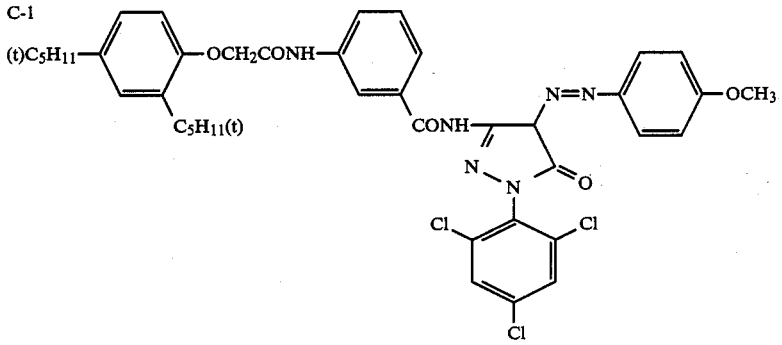

C-2

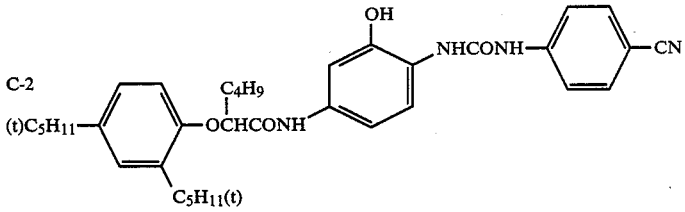

C-3

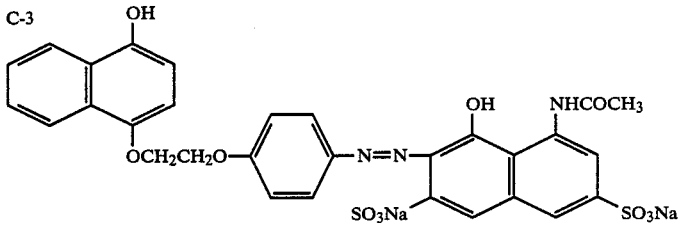

C-4

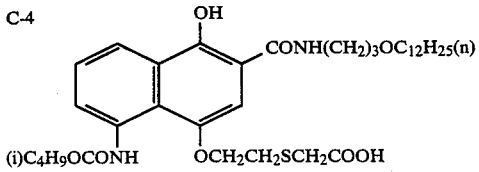

-continued
C-5
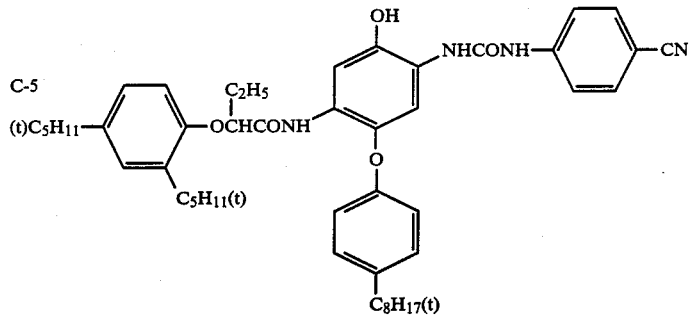
C-6
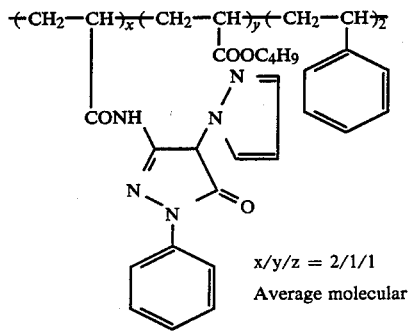
x/y/z = 2/1/1
Average molecular weight: about 30,000
C-7
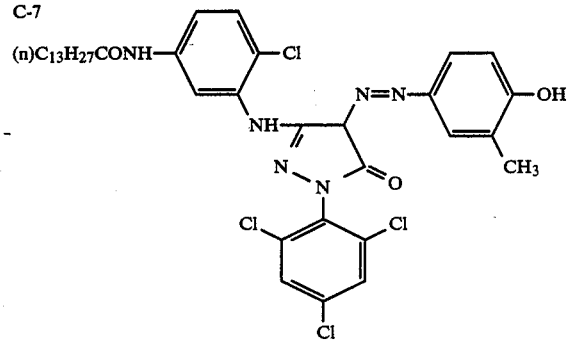
C-8
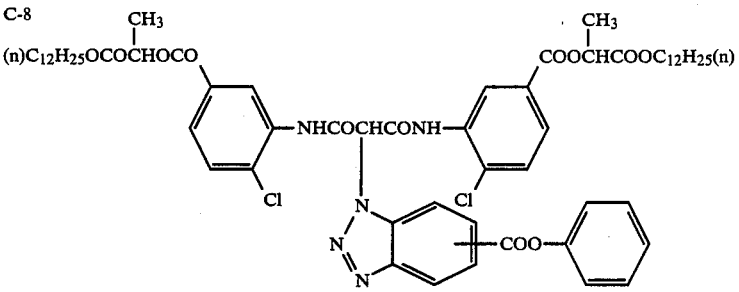
C-9
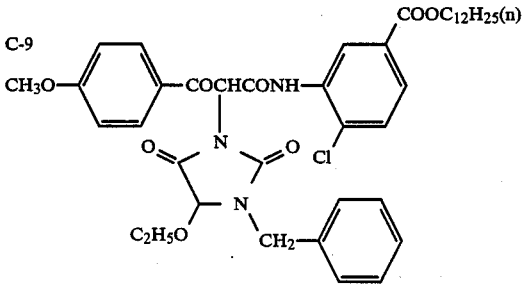

-continued
C-10
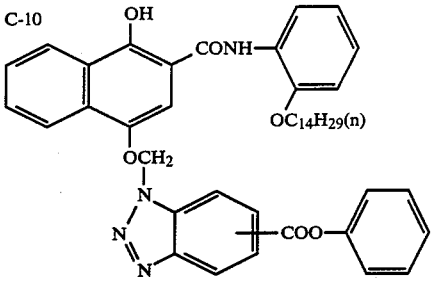
HBS-1: Tricresyl phosphate
HBS-2: Dibutyl phthalate
H-1
$CH_2{=}CH{-}SO_2{-}CH_2{-}CONH{-}CH_2$
$CH_2{=}CH{-}SO_2{-}CH_2{-}CONH{-}CH_2$
Sensitizing Dye I
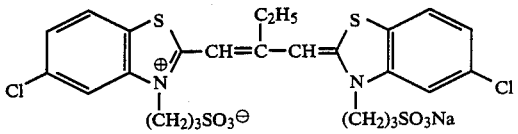
Sensitizing Dye II
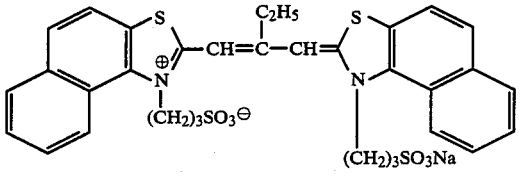
Sensitizing Dye III
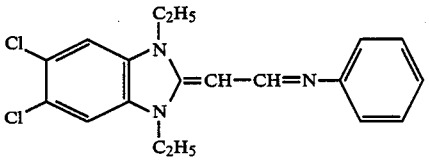
Sensitizing Dye IV
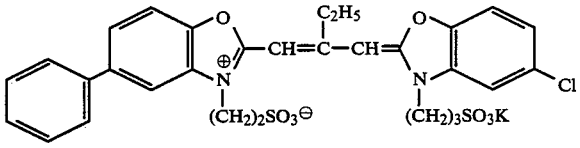
Sensitizing Dye V
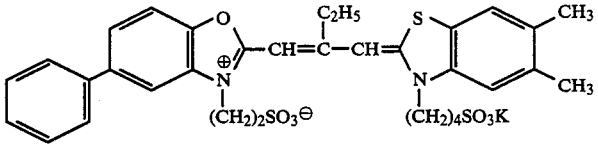
Sensitizing Dye VI
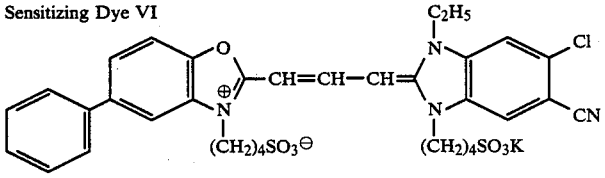

-continued

Sensitizing Dye VII

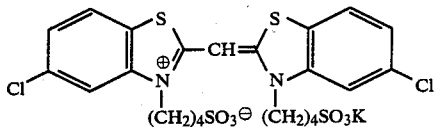

Sensitizing Dye VIII

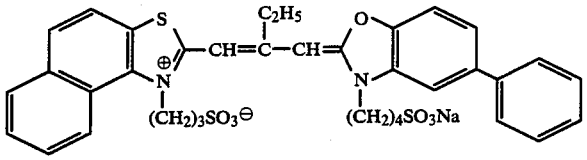

S-1

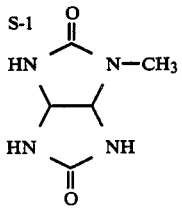

S-2

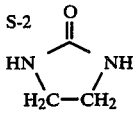

After the multilayer color photographic material thus prepared (Sample 101) was exposed using a tungsten light source to light of 25 cms wherein the color temperature was adjusted to 4,800° K. by a filter, Sample 101 was processed at 38° C. according to the following steps:

| Step | Time Period |
|---|---|
| Color Development | 3 min 15 sec |
| Bleaching | 3 min |
| Fixing | 3 min 15 sec |
| Washing | 1 min 30 sec |
| Stabilizing | 45 sec |

The compositions used in the above processing steps were as follows:

| Color Developing Solution | |
|---|---|
| Diethylenetriaminepentaacetic acid | 1.0 g |
| 1-Hydroxyethylidene-1,-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N—Ethyl-N—β-hydroxyethylamino)-2-methylaniline sulfate | 4.5 g |
| Water to make | 1.0 liter |
| pH | 10.0 |

| Bleaching Solution | |
|---|---|
| Ferric complex salt (bleaching agent: a ferric ammonium salt of the organic acid given in Table 1) | 0.5 mol |
| Chelating agent (the organic acid given in Table 1) | 0.05 mol |
| Ammonium bromide | 150 g |
| Ammonium nitrate | 10 g |
| Water to make | 1.0 liter |
| pH | 6.0 |

Herein, the term "chelating agent" refers to the same type of organic acid as the organic acid ferric ammonium salt used for the bleaching agent.

| Fixing Solution | |
|---|---|
| Ethylenediaminetetraacetic acid disodium salt | 1.0 g |
| Sodium sulfite | 4.0 g |
| Aqueous ammonium thiosulfate solution (700 g/liter) | 250.0 ml |
| Sodium bisulfite | 4.6 g |
| Water to make | 1.0 liter |
| pH | 6.6 |

| Washing Solution | |
|---|---|
| Ethylenediaminetetraacetic acid disodium salt | 0.4 g |
| Water to make | 1.0 liter |
| pH | 7.5 |

| Stabilizing Solution | |
|---|---|
| Formalin (40 wt % aqueous solution) | 2.0 ml |
| Polyoxyethylene-p-monononylphenylether (average polymerization degree: about 10) | 0.3 g |
| Water to make | 1.0 liter |

Samples prepared as above were processed in accordance with the above-described processing steps, but employing bleaching solutions Nos. 1 to 16 shown in Table 1 below.

With respect to each photographic material thus processed as described above, the residual amount of silver at the area having a maximum color density was determined by fluorescent X-ray analysis. The results are given in Table 1.

TABLE 1

| No. | Organic Acid for Bleaching Agent And as Chelating Agent | Residual Amount of Silver ($\mu g/cm^2$) |
|---|---|---|
| 1* | Ethylenediaminetetraacetic Acid** (Comparative Compound 1**) | 15.4 |
| 2 | Compound A-1 | 4.3 |
| 3 | Compound A-2 | 4.8 |
| 4 | Compound A-3 | 4.2 |
| 5 | Compound A-4 | 4.7 |
| 6 | Compound A-6 | 3.9 |
| 7 | Compound A-11 | 5.0 |
| 8 | Compound A-15 | 4.6 |
| 9 | Compound A-17 | 4.5 |
| 10 | Compound A-31 | 4.1 |
| 11 | Compound A-36 | 4.9 |
| 12 | Compound A-39 | 4.8 |
| 13* | Comparative Compound 2** | 50.5 |
| 14* | Comparative Compound 3** | 8.3 |
| 15* | Comparative Compound 4** | 35.2 |
| 16* | Comparative Compound 5** | 30.8 |

*Comparative samples

**Comparative Compounds

1. Ethylenediaminetetraacetic acid

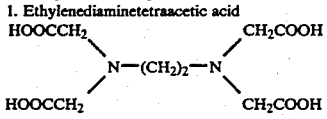

2. Ethylenediaminetetramethylenephosphonic acid

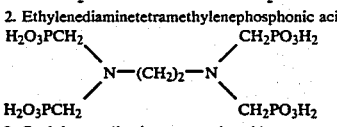

3. Cyclohexanediaminetetraacetic acid

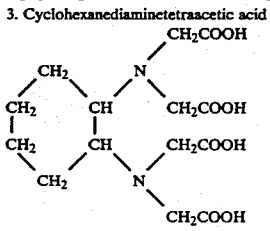

4. 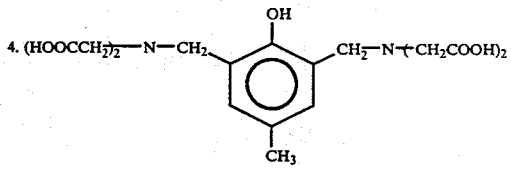

5. 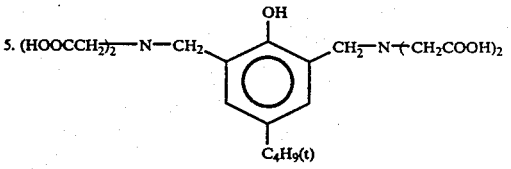

As is apparent from Table 1, it can be understood that when aromatic compounds having at least one group represented by general formula (I) are used as a complexing agent for a bleaching agent, excellent images with a small residual amount of silver can be obtained.

On the other hand, it is also clear that when known complexing agents (Comparative Compounds 1 and 3) are used or an aliphatic compound (Comparative Compound 2) having a group represented by general formula (I) or aromatic compounds (Comparative Compounds 4 and 5) not having a group represented by general formula (I) are used as a complexing agent, the residual amount of silver in images is undesirably high, and good images are thus not obtained.

EXAMPLE 2

The multilayer color photographic material prepared in Example 1 was exposed in the same manner as in Example 1, and was processed at 38° C. according to the following steps.

| Processing Step | Time Period |
|---|---|
| Color Development | 3 min 15 sec |
| Bleaching | 45 sec |
| Bleach-Fixing | 2 min 30 sec |
| Washing | 1 min 30 sec |
| Stabilizing | 45 sec |

The compositions of the color developing solution and the stabilizing solution were the same as those in Example 1, and the compositions of other processing solutions were as follows:

| Bleaching Solution | |
|---|---|
| Ferric complex salt (bleaching agent: a ferric ammonium salt of the organic acid given in Table 2) | 0.5 mol |
| Chelating agent (the organic acid given in Table 2) | 0.05 mol |
| Ammonium bromide | 150 g |
| Ammonium nitrate | 10 g |
| Water to make | 1 liter |
| pH | 6.0 |

| Bleach-Fixing Solution | |
|---|---|
| Bleaching agent (the same as in the bleaching solution) | 0.3 mol |
| Chelating compound (the same as in the bleaching solution) | 0.05 mol |
| Sodium sulfite | 15 g |
| Aqueous ammonium thiosulfate solution (700 g/liter) | 250 ml |
| Water to make | 1 liter |
| pH | 7.0 |

Herein, the term "chelating agent" in the bleaching solution and the bleach-fixing solution refers to the same type of organic acid as the organic acid ferric ammonium salt used for the bleaching agent.

| Washing Solution | |
|---|---|
| 2-Methyl-4-isothiazoline-3-one | 3 mg |
| 5-Chloro-2-methyl-4-isothiazoline-3-one | 6 mg |
| Ethylene glycol | 1.5 ml |
| Water to make | 1 liter |

With respect to the processed photographic material, the residual amount of silver at the area having a maximum color density was determined by fluorescent X-ray analysis. The results are given in Table 2.

TABLE 2

| No. | Organic Acid for Bleaching Agent And as Chelating Agent | Residual Amount of Silver ($\mu g/cm^2$) |
|---|---|---|
| 1* | Ethylenediaminetetraacetic Acid | 18.6 |
| 2 | Compound A-1 | 5.0 |
| 3 | Compound A-2 | 4.9 |
| 4 | Compound A-3 | 5.1 |
| 5 | Compound A-4 | 4.8 |
| 6 | Compound A-6 | 4.6 |
| 7 | Compound A-11 | 5.0 |
| 8 | Compound A-15 | 5.3 |
| 9 | Compound A-17 | 5.2 |
| 10 | Compound A-31 | 5.1 |

TABLE 2-continued

| No. | Organic Acid for Bleaching Agent And as Chelating Agent | Residual Amount of Silver ($\mu g/cm^2$) |
|---|---|---|
| 11 | Compound A-36 | 5.4 |
| 12 | Compound A-39 | 5.1 |

*Comparative samples

As is shown in Table 2, when the exemplified compounds according to the present invention were used as a complexing agent for a bleaching agent, excellent photographic images with a small residual amount of silver were obtained.

EXAMPLE 3

The multilayer color photographic material prepared in Example 1 was cut into a shape of a roll film with a width of 35 mm, and was imagewise exposed, then processed in an amount of 30 m per day for 1 month continuously (the processing temperature: 38° C.) using an EP 350 automatic developing machine (manufactured by Fuji Photo Film Co., Ltd.) that had been modified in part. The specifications of the developing machine and the processing steps were as follows.

| Step | Processing Period | Tank Volume (l) | Replenisher (ml) |
|---|---|---|---|
| Color Developing | 3 min 15 sec | 10 | 38 |
| Bleaching | 45 sec | 4 | 18 |
| Bleach-Fixing | 2 min 30 sec | 10 | 27 |
| Washing (1) | 40 sec | 4 | — |
| Washing (2) | 1 min 00 sec | 4 | 27 |
| Stabilizing | 40 sec | 4 | 18 |

In the above steps, the "replenisher" means the amount of solution supplied per meter of the roll film with a width of 35 mm. The washings (1) and (2) were such that a countercurrent washing method from (2) to (1) was carried out. The overflow solution resulting from the supply of the bleaching solution was introduced into the bleach-fixing solution.

The compositions of the processing solutions were as follows:

| Color Developing Solution: | Tank Solution | Replenisher |
|---|---|---|
| Diethylenetriaminepentaacetic acid | 1.0 g | 1.1 g |
| 1-Hydroxyethylidene-1,1-diphosphonic acid | 2.0 g | 2.2 g |
| Sodium sulfite | 4.0 g | 4.4 g |
| Potassium carbonate | 30.0 g | 32.0 g |
| Potassium bromide | 1.4 g | 0.7 g |
| Potassium iodide | 1.3 mg | — |
| Hydroxylamine sulfate | 2.4 g | 2.6 g |
| 4-(N—Ethyl-N—β-hydroxyethylamino)-2-methylaniline sulfate | 4.5 g | 5.0 g |
| Water to make | 1 l | 1 l |
| pH | 10.00 | 10.05 |

| Bleaching Solution (the tank solution and the replenisher were the same) | |
|---|---|
| Ammonium bromide | 100 g |
| Ferric complex salt (bleaching agent: a ferric ammonium salt of the organic acid given in Table 3) | 0.06 mol |
| Ethylenediaminetetraacetic acid ferric ammonium salt | 96 g |
| Ethylenediaminetetraacetic acid disodium salt | 10.0 g |

-continued

| | |
|---|---|
| Ammonium nitrate | 10.0 g |
| The following bleaching accelerator | 2.0 g |

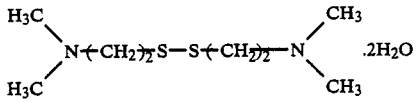

| | |
|---|---|
| Ammonia water | 17 ml |
| Water to make | 1 liter |
| pH | 6.5 |

| Bleach-Fixing Solution: | Tank Solution | Replenisher |
|---|---|---|
| Ammonium bromide | 50.0 g | — |
| Bleaching agent (the same as in the bleaching solution) | 0.03 mol | — |
| Ethylenediaminetetraacetic acid ferric ammonium salt | 40 g | — |
| Disodium ethylenediaminetetraacetate | 5.0 g | 1.0 g |
| Ammonium nitrate | 5.0 g | — |
| Ammonium sulfite | 12.0 g | 20.0 g |
| Aqueous ammonium thiosulfate solution (700 g/liter) | 240 ml | 400 ml |
| Ammonia water | 10.0 ml | — |
| Water to make | 1 l | 1 l |
| pH | 7.3 | 8.0 |
| Washing Solutions (1) and (2) (the tank solution and the replenisher were the same) | | |

"Desalted water" was used.

Herein, "desalted water" is water obtained by processing usual tap water with a cationic exchange resin ("Diaion SK-1B", a trade name, manufactured by Mitsubishi Chemical Industries, Ltd.) to reduce the calcium and magnesium concentration in the water to 5 mg/liter or below.

| Stabilizing Solution (the tank solution and the replenisher were the same) | |
|---|---|
| Fromalin (40 wt % aqueous solution) | 2.0 ml |
| Polyoxyethylene-p-monononylphenylether (average polymerization degree: about 10) | 0.3 g |
| Water to make | 1 liter |

the processing solutions after the continuous processing were used to process the photographic material exposed in the same manner as in Example 1 and the residual amount of silver at the area having a maximum color density was determined by fluorescent X-ray analysis. The results are given in Table 3.

TABLE 3

| No. | Organic Acid for Bleaching Agent | Residual Amount of Silver ($\mu g/cm^2$) | Maximum Density of Cyan |
|---|---|---|---|
| 1* | Ethylenediaminetetraacetic Acid | 15.9 | 2.20 |
| 2 | Compound A-3 | 4.2 | 2.57 |
| 3 | Compound A-6 | 3.1 | 2.58 |

*Comparative sample

As is apparent from Table 3, when the present complexing agents for a bleaching agent were used, excellent photographic images were obtained wherein the residual amount of silver was small, the cyan density after processing was high, and defective color restoration was less.

On the other hand, when processing was carried out using the bleaching solution containing the comparative compound as a complexing agent, desilvering was insufficient in spite of the fact that the same amount of the replenisher was used as in the case of the processing by using the present bleaching solution. This shows that when processing was carried out using the present bleaching solution, excellent photographic images were obtained with a smaller supply of processing solution.

EXAMPLE 4

Onto a cellulose triacetate film base coated with a subbing layer were applied layers having the following compositions to prepare a multilayer color photographic material, which was designated Sample 201.

| A First Layer: An Antihalation Layer | |
|---|---|
| A gelatin layer (dry film thickness: 2 μm) containing the following: | |
| Black colloidal silver | 0.25 g/m$^2$ |
| Ultraviolet Absorber UV-1 | 0.04 g/m$^2$ |
| Ultraviolet Absorber UV-2 | 0.1 g/m$^2$ |
| Ultraviolet Absorber UV-3 | 0.1 g/m$^2$ |
| High Boiling Point Organic Solvent Oil-2 | 0.01 cc/m$^2$ |

| A Second Layer: An Intermediate Layer | |
|---|---|
| A gelatin layer (dry film thickness: 1 μm) containing the following: | |
| Compound Cpd-C | 0.05 g/m$^2$ |
| Compound I-1 | 0.05 g/m$^2$ |
| High Boiling Point Organic Solvent Oil-1 | 0.05 cc/m$^2$ |

| A Third Layer: A First Red-Sensitive Emulsion Layer | |
|---|---|
| A gelatin layer (dry film thickness: 1 μm) containing the following: | |
| Silver bromoiodide emulsion (average grain diameter: 0.3 μm, AgI content: 4 mol %) spectrally sensitized with Sensitizing Dyes S-I and S-II | 0.5 g/m$^2$ (silver) |
| Coupler C-1' | 0.2 g/m$^2$ |
| Coupler C-2' | 0.05 g/m$^2$ |
| Compound I-2 | $2 \times 10^{-3}$ g/m$^2$ |
| High Boiling Point Organic Solvent Oil-1 | 0.12 cc/m$^2$ |

| A Fourth Layer: A Second Red-Sensitive Emulsion Layer | |
|---|---|
| A gelatin layer (dry film thickness: 2.5 μm) containing the following: | |
| Silver bromoiodide emulsion (average grain diameter: 0.6 μm, AgI content: 3 mol %) spectrally sensitized with Sensitizing Dyes S-I and S-II | 0.8 g/m$^2$ (silver) |
| Coupler C-1' | 0.55 g |
| Coupler C-2' | 0.14 g/m$^2$ |
| Compound I-2 | $1 \times 10^{-3}$ g/m$^2$ |
| High Boiling Point Organic Solvent Oil-1 | 0.33 cc/m$^2$ |
| Dye D-1 | 0.02 g/m$^2$ |

| A Fifth Layer: An Intermediate Layer | |
|---|---|
| A gelatin layer (dry film thickness: 1 μm) containing the following: | |
| Compound Cpd-C | 0.1 g/m$^2$ |
| High Boiling Point Organic Solvent Oil-1 | 0.1 cc/m$^2$ |
| Dye D-2 | 0.02 g/m$^2$ |

| A Sixth Layer: A First Green-Sensitive Emulsion Layer | |
|---|---|
| A gelatin layer (dry film thickness: 1 μm) containing the following: | |
| Silver bromoiodide emulsion (average grain diameter: 0.3 μm, AgI content: 4 mol %) spectrally sensitized with Sensitizing Dyes S-III and S-IV | 0.7 g/m$^2$ (silver) |
| Coupler C-3' | 0.20 g/m$^2$ |
| Coupler C-5' | 0.10 g/m$^2$ |
| High Boiling Point Organic Solvent Oil-1 | 0.26 cc/m$^2$ |

-continued

| A Seventh Layer: A Second Green-Sensitive Emulsion Layer | |
|---|---|
| A gelatin layer (dry film thickness: 2.5 μm) containing the following: | |
| Silver bromoiodide emulsion (average grain diameter: 0.6 μm, AgI content: 2.5 mol %) spectrally sensitized with Sensitizing Dyes S-III and S-IV | 0.7 g/m$^2$ (silver) |
| Coupler C-4' | 0.10 g/m$^2$ |
| Coupler C-5' | 0.10 g/m$^2$ |
| High Boiling Point Organic Solvent Oil-2 | 0.05 cc/m$^2$ |
| Dye D-3 | 0.05 g/m$^2$ |

| An Eighth Layer: An Intermediate Layer | |
|---|---|
| A gelatin layer (dry film thickness: 1 μm) containing the following: | |
| Compound Cpd-C | 0.05 g/m$^2$ |
| High Boiling Point Organic Solvent Oil-2 | 0.1 cc/m$^2$ |
| Dye D-4 | 0.01 g/m$^2$ |

| A Ninth Layer: A Yellow Filter Layer | |
|---|---|
| A gelatin layer (dry film thickness: 1 μm) containing the following: | |
| Yellow colloidal silver | 0.1 g/m$^2$ |
| Compound Cpd-C | 0.02 g/m$^2$ |
| Compound Cpd-B | 0.03 g/m$^2$ |
| High Boiling Point Organic Solvent Oil-1 | 0.04 cc/m$^2$ |

| A Tenth Layer: A First Blue-Sensitive Emulsion Layer | |
|---|---|
| A gelatin layer (dry film thickness: 1.5 μm) containing the following: | |
| Silver bromoiodide emulsion (average grain diameter: 0.3 μm, AgI content: 2 mol %) spectrally sensitized with Sensitizing Dye S-V | 0.6 g/m$^2$ (silver) |
| Coupler C-6' | 0.1 g/m$^2$ |
| Coupler C-7' | 0.4 g/m$^2$ |
| High Boiling Point Organic Solvent Oil-1 | 0.1 cc/m$^2$ |

| An Eleventh Layer: A Second Blue-Sensitive Emulsion Layer | |
|---|---|
| A gelatin layer (dry film thickness: 3 μm) containing the following: | |
| Silver bromoiodide emulsion (average grain diameter: 0.6 μm, AgI content: 2 mol %) spectrally sensitized with Sensitizing Dye S-VI | 1.1 g/m$^2$ (silver) |
| Coupler C-6' | 0.4 g/m$^2$ |
| Coupler C-8' | 0.8 g/m$^2$ |
| High Boiling Point Organic Solvent Oil-1 | 0.23 cc/m$^2$ |
| Dye D-5 | 0.02 g/m$^2$ |

| A Twelfth Layer: A First Protective Layer | |
|---|---|
| A gelatin layer (dry film thickness: 2 μm) containing the following: | |
| Ultraviolet Absorber UV-1 | 0.02 g/m$^2$ |
| Ultraviolet Absorber UV-2 | 0.32 g/m$^2$ |
| Ultraviolet Absorber UV-3 | 0.03 g/m$^2$ |
| High Boiling Point Organic Solvent Oil-2 | 0.28 cc/m$^2$ |

| A Thirteenth Layer: A Second Protective Layer | |
|---|---|
| A gelatin layer (dry film thickness: 2.5 μm) containing the following: | |
| An emulsion of silver bromoiodide fine grains whose surface was fogged (iodine content: 1 mol %, average grain size: 0.06 μm) | 0.1 g/m$^2$ (silver) |
| Polymethyl methacrylate particles (average particle diameter: 1.5 μm) | 0.54 g/m$^2$ |

The above layers contained, in addition to the above components, Gelatin Hardener H-1 (that was the same as in Example 1) and surface active agents.

The compounds that were used to prepare the sample are given below:
C-1'
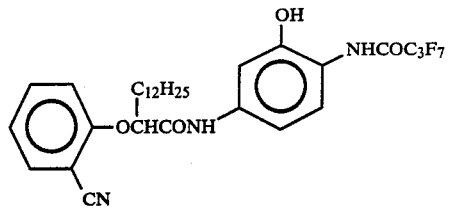
C-2'
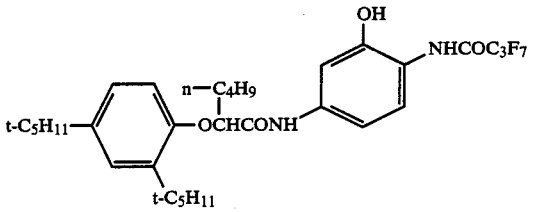
C-3'
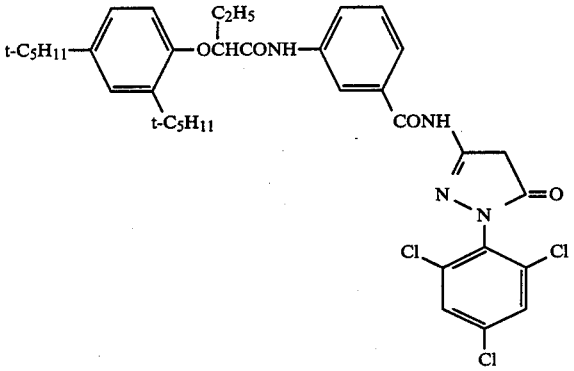
C-4'
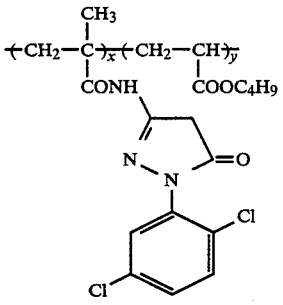
x/y = 1/1
C-5'
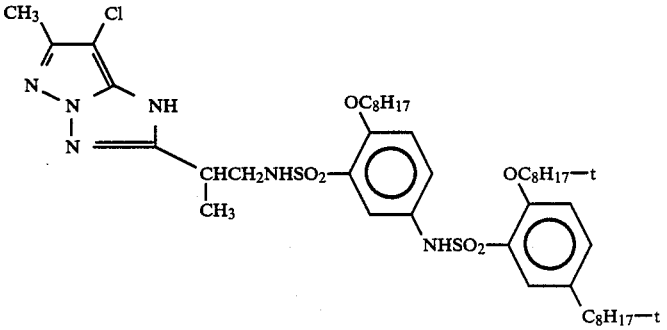

-continued
C-6'
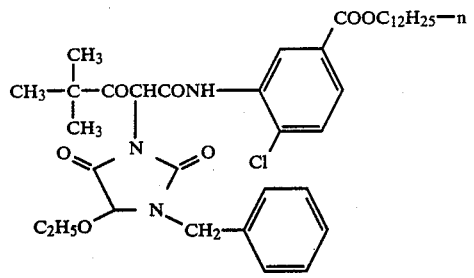
C-7'
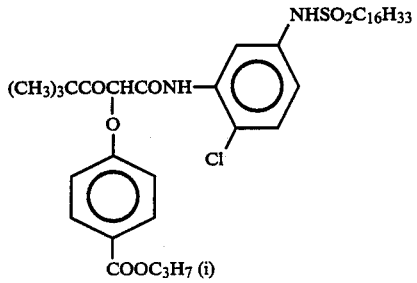
C-8'
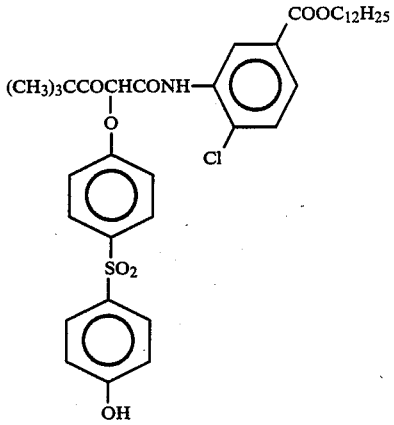
Compound I-1
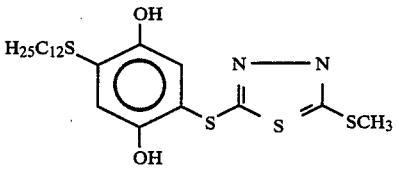
Compound I-2
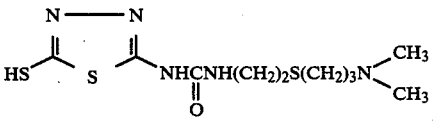
UV-1
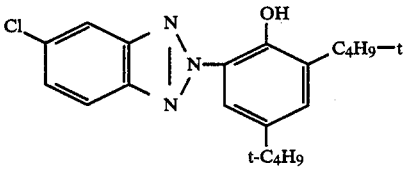
UV-2
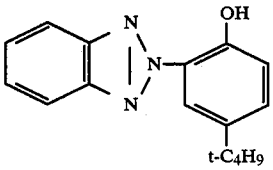

-continued
UV-3
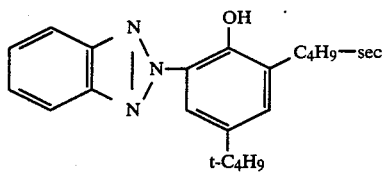
Cpd-B
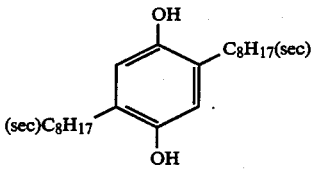
Cpd-C
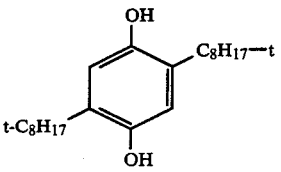
S-I
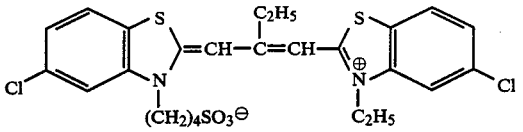
S-II
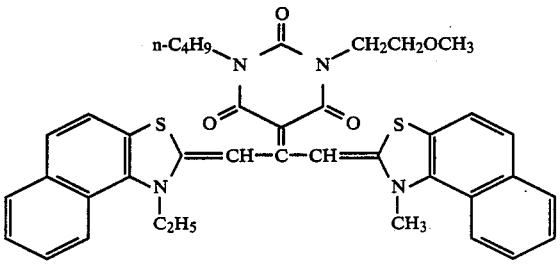
S-III
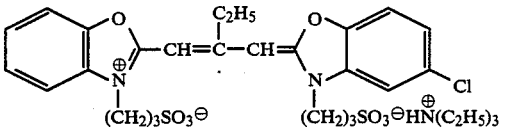
S-IV
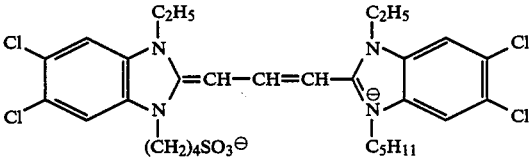
S-V
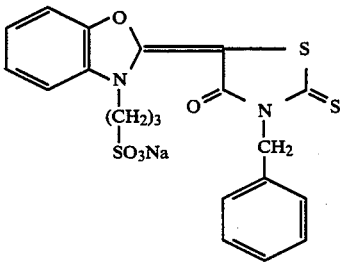

-continued

S-VI

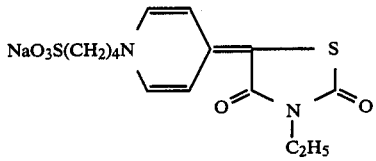

D-1

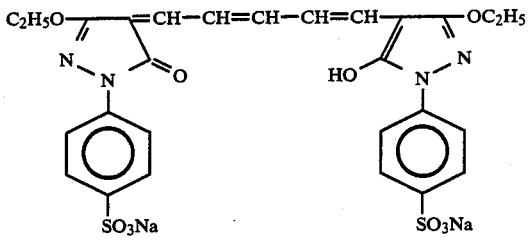

D-2

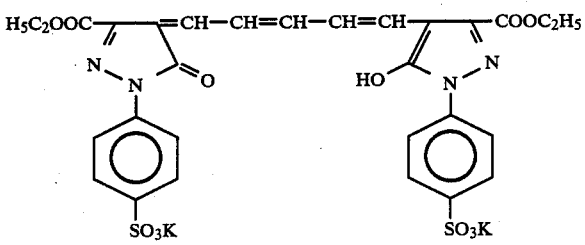

D-3

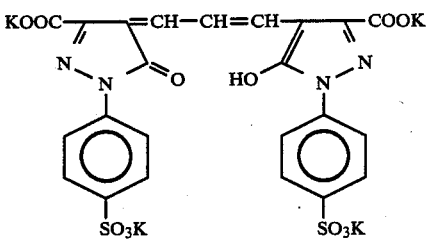

D-4

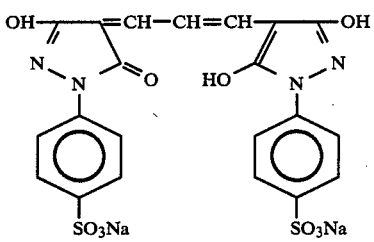

D-5

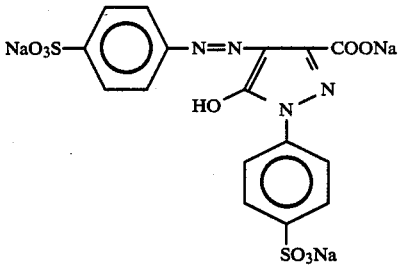

Oil-1: Tricresyl phosphate

Oil-2: Dibutyl phthalate

The emulsion grains used in Sample 201 consisted of multiple twinned crystals and the aspect ratio was up to 3 (Emulsion A being designated for the eleventh layer, Emulsion B for tenth layer, Emulsion C for the seventh layer and Emulsion D for the fourth layer, respectively). The dry film thickness from the third layer to the thirteenth layer (hereinafter referred to as "d") was 19.0 μm.

Sample 202 wherein d=13.5 μm was prepared by reducing the coating amount of gelatin from the third layer to the twelfth layer in Sample 201 to allow the oil-soluble component/gelatin ratio of these layers to correlate with Sample 201.

Tabular emulsions shown below that would give rise to the same sensitivities as those of the fourth layer, the seventh layer, the tenth layer and the eleventh layer, respectively, of Sample 201 were prepared in a known manner, and were labeled Emulsions E to H. These emulsions were applied in the same manner as for Sample 202 to prepare Sample 203.

| Emulsion | Layer | Aspect Ratio | AgI Content (mol %) |
|---|---|---|---|
| E | In a fourth layer | 8 | 3 |
| F | In a seventh layer | 8 | 2.5 |
| G | In a tenth layer | 12 | 2.0 |
| H | In an eleventh layer | 12 | 2.0 |

The thus prepared Samples 201 to 203 were subjected to white-wedge exposure and were then subjected to the following development processing step.

| Processing Steps | | |
|---|---|---|
| Step | Time Period | Temperature (°C.) |
| First Development | 6 min | 38 |
| Washing (1) | 2 min | 38 |
| Reversing | 2 min | 38 |
| Color Development | 6 min | 38 |
| Adjustment | 2 min | 38 |
| Bleaching | 3 min | 38 |
| Fixing | 3 min | 38 |
| Washing (2) | 2 min | 38 |
| Stabilizing | 1 min | 38 |
| Drying | 1 min 15 sec | 55 |

The compositions of the processing solutions were as follows:

| First Developing Solution: | |
|---|---|
| Water | 700 ml |
| Nitrilo-N,N,N—trimethylenephosphonic acid pentasodium salt | 2.0 g |
| Sodium sulfite | 30 g |
| Hydroquinone.monosulfonic acid potassium | 20 g |
| Potassium carbonate | 33 g |
| 1-Phenyl-4-methyl-4-hydroxymethyl-3-pyrazolidone | 2.0 g |
| Potassium bromide | 2.5 g |
| Potassium thiocyanate | 1.2 g |
| Potassium iodide (0.1 wt % aq. soln.) | 2 ml |
| Water to make | 1 liter |
| pH: 9.6 (adjusted using hydrochloric acid or potassium hydroxide) | |

| Reversing Solution: | |
|---|---|
| Water | 700 ml |
| Nitrilo-N,N,N—trimethylenephosphonic acid pentasodium salt | 3.0 g |
| Stannous chloride (dihydrate) | 1.0 g |
| p-Aminophenol | 0.1 g |
| Sodium hydroxide | 8 g |
| Glacial acetic acid | 15 ml |
| Water to make | 1 liter |
| pH: 6.0 (adjusted using hydrochloric acid or sodium hydroxide) | |

| Color Developing Solution: | |
|---|---|
| Water | 700 ml |
| Nitrilo-N,N,N—trimethylenephosphonic acid pentasodium salt | 2.0 g |
| Sodium sulfite | 7.0 g |
| Trisodium phosphate (dodecahydrate) | 36 g |
| Potassium bromide | 1.0 g |
| Potassium iodide (0.1 wt % aq. soln.) | 90 ml |

-continued

| | |
|---|---|
| Sodium hydroxide | 3.0 g |
| Citrazinic acid | 1.5 g |
| N—Ethyl-N—(β-methanesulfonamidoethyl)-3-methyl-4-aminoaniline sulfate | 11 g |
| 3,6-Dithiaoctane-1,8-diol | 1.0 g |
| Water to make | 1 liter |
| pH: 11.80 (adjusted using hydrochloric acid or sodium hydroxide) | |

| Adjusting Solution: | |
|---|---|
| Water | 700 ml |
| Sodium sulfite | 12 g |
| Ethylenediamine-N,N,N',N'—tetraacetic acid disodium salt (dihydrate) | 8.0 g |
| 1-Thioglycerin | 0.4 ml |
| Water to make | 1 liter |
| pH: 6.20 (adjusted using hydrochloric acid or sodium hydroxide) | |

| Bleaching Solution: | |
|---|---|
| Water | 700 ml |
| Ferric complex salt (bleaching agent: a ferric ammonium salt of the organic acid given in Table 4) | 0.3 mol |
| Chelating agent (the organic acid given in Table 4) | 0.01 mol |
| Potassium bromide | 100 g |
| Ammonium nitrate | 10 g |
| Water to make | 1 liter |
| pH: 5.7 (adjusted using hydrochloric acid or ammonia water) | |

The chelating agent used was the same type of organic acid as that of the organic acid ferric complex salt used in the bleaching agent.

| Fixing Solution: | |
|---|---|
| Water | 800 ml |
| Ammonium thiosulfate | 80 g |
| Sodium sulfite | 5.0 g |
| Sodium bisulfite | 5.0 g |
| Water to make | 1 liter |
| pH: 6.6 (adjusted using hydrochloric acid or ammonia water) | |

| Washing Solutions (1) and (2): |
|---|
| Desalted water as in Example 3 was used. |

| Stabilizing Solution: | |
|---|---|
| Water | 800 ml |
| Formalin (37 wt % aq. soln.) | 5.0 ml |
| Polyoxyethylene p-monononylphenyl-ether (Fuji Driwel, manufactured by Fuji Photo Film Co., Ltd.) | 5.0 ml |
| Water to make | 1 liter |

With respect to the thus processed Samples 201 to 203, the residual amount of silver in the area having a maximum density was determined by fluorescent X-ray analysis. The results are given in Table 4.

TABLE 4

| No. | Sample No. | Organic Acid for Bleaching Agent and as Chelating Agent | Residual Amount of Silver ($\mu g/cm^2$) |
|---|---|---|---|
| 1* | 201 | Ethylenediamine-tetraacetic Acid | 18.6 |
| 2* | 202 | Ethylenediamine-tetraacetic Acid | 12.4 |
| 3* | 203 | Ethylenediamine-tetraacetic Acid | 8.3 |
| 4 | 201 | Compound A-1 | 3.1 |
| 5 | 202 | " | 1.0 |
| 6 | 203 | " | 0.8 |
| 7 | 201 | Compound A-6 | 4.0 |

TABLE 4-continued

| No. | Sample No. | Organic Acid for Bleaching Agent and as Chelating Agent | Residual Amount of Silver ($\mu g/cm^2$) |
|---|---|---|---|
| 8 | 202 | " | 1.3 |
| 9 | 203 | " | 1.0 |

*Comparative samples

As is apparent from Table 4, when the processing was carried out using the present bleaching solution, excellent images with a small residual amount of silver were obtained. When the dry film thickness was decreased from 19 μm to 13.5 μm, excellent images with a further reduced residual amount of silver were obtained. When the aspect ratio of the emulsion was increased from 3 or below to 8–12, better images with the residual amount of silver being reduced further were obtained.

EXAMPLE 5

Preparation of a Silver Halide Emulsion:

A silver chlorobromide emulsion (1) was prepared as shown below:

| | |
|---|---|
| A First Solution: | |
| $H_2O$ | 1,000 ml |
| NaCl | 5.5 g |
| Gelatin | 32 g |
| A Second Solution: | |
| Sulfuric acid (1 N) | 20 ml |
| A Third Solution: | |
| The following compound (1 wt % aq. soln.) | 3 ml |

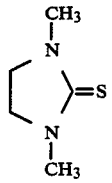

| | |
|---|---|
| A Fourth Solution: | |
| KBr | 2.80 g |
| NaCl | 0.34 g |
| $H_2O$ to make | 140 ml |
| A Fifth Solution: | |
| $AgNO_3$ | 5 g |
| $H_2O$ to make | 140 ml |
| A Sixth Solution: | |
| KBr | 67.24 g |
| NaCl | 8.26 g |
| $K_2IrCl_6$ (0.001 wt % aq. soln.) | 0.7 ml |
| $H_2O$ to make | 320 ml |
| A Seventh Solution: | |
| $AgNO_3$ | 120 g |
| $H_2O$ to make | 320 ml |

The first solution was heated to 75° C., and the second solution and the third solution were added thereto. Thereafter, the fourth and fifth solutions were added simultaneously thereto over 9 minutes. Then after 10 minutes, the sixth and seventh solutions were added simultaneously thereto over 45 minutes. 5 minutes after this addition, the temperature was lowered, and desalting was effected. Then, water and dispersed gelatin were added thereto, and the pH was adjusted to 6.2, thereby providing a monodispersed cubic silver chlorobromide emulsion wherein the average grain size was 1.01 μm, the coefficient of variation (the value obtained by dividing the standard deviation by the average grain size: s/d) was 0.08, and the content of silver bromide was 80 mol %. Sodium thiosulfate was added to that emulsion to chemically sensitize the emulsion.

Then, a silver chlorobromide emulsion (2) was prepared as shown below:

| | |
|---|---|
| An Eighth Solution: | |
| $H_2O$ | 1,000 ml |
| NaCl | 5.5 g |
| Gelatin | 32 g |
| Ninth Solution: | |
| Sulfuric acid (1 N) | 24 ml |
| A Tenth Solution: | |
| The compound in the third solution above (1 wt % aq. soln.) | 3 ml |
| An Eleventh Solution: | |
| KBr | 17.92 g |
| NaCl | 2.20 g |
| $H_2O$ to make | 220 ml |
| A Twelfth Solution: | |
| $AgNO_3$ | 32 g |
| $H_2O$ to make | 200 ml |
| A Thirteenth Solution: | |
| KBr | 71.68 g |
| NaCl | 8.81 g |
| $K_2IrCl_6$ (0.001 wt % aq. soln.) | 4.5 ml |
| $H_2O$ to make | 600 ml |
| A Fourteenth Solution: | |
| $AgNO_3$ | 128 g |
| $H_2O$ to make | 600 ml |

The eighth solution was heated to 56° C., and the ninth and tenth solutions were added thereto. Thereafter, the eleventh and twelfth solutions were added simultaneously over 30 minutes. 10 minutes later the thirteenth and fourteenth solutions were added simultaneously over 20 minutes. 5 minutes after this addition, the temperature was lowered and desalting was effected. Water and dispersed gelatin were added and the pH was adjusted to 6.2, thereby providing a monodispersed cubic silver chlorobromide wherein the average grain size was 0.45 μm, the coefficient of variation was 0.08, and the content of silver bromide was 80 mol %. Sodium thiosulfate was added to that emulsion to effect chemical sensitization.

Then, an emulsion having a low content of silver bromide was prepared. In a similar manner to that for the emulsions (1) and (2), except that the period of addition of the solutions, and the amount of KBr and NaCl were changed, silver chlorobromide emulsions (3) and (4) having a silver bromide content of 1 mol % were prepared. The average grain size and the value of the coefficient of variation of the obtained emulsions are given in Table A.

TABLE A

| Emulsion No. | AgBr:AgCl (molar ratio) | Average Grain Size (μm) | Coefficient of Variation | Layer |
|---|---|---|---|---|
| (1) | 80:20 | 1.01 | 0.08 | Blue-sensitive |
| (2) | 80:20 | 0.45 | 0.08 | Green- and red-sensitive |
| (3) | 1:99 | 1.00 | 0.08 | Blue-sensitive |
| (4) | 1:99 | 0.45 | 0.07 | Green- and red-sensitive |

Preparation of a Color Photographic Material:

On a paper base (the opposite surfaces of which were laminated with polyethylene), a color print paper (Sample 301) having the layer structure shown in Table B below was produced. The coating solutions were prepared as shown below.

Preparation of a First Coating Solution:

10 ml of ethyl acetate and 4 ml of Solvent (c) were added to 10 g of Yellow Coupler (a) and 23 g of Dye Stabilizer (b) to dissolve them, and the solution was emulsified and dispersed into 90 ml of a 10% aqueous gelatin solution containing 5 ml of a 10% aqueous sodium dodecylbenzenesulfonate solution. A blue-sensitive sensitizing dye shown below was added to the silver chlorobromide emulsion (1) (silver bromide content: 80 mol %, silver content: 70 g/kg) in an amount of $7\times10^{-4}$ mol per mol of silver chlorobromide to prepare a blue-sensitive emulsion. The emulsified dispersion and the emulsion were mixed and dissolved, and the concentration was adjusted using gelatin so that the composition would become that shown in Table B to prepare a first layer coating solution.

In the same manner as that for the first layer coating solution, second to seventh coating solutions were prepared.

A gelatin hardening agent for each layer was 1-oxy-3,5-dichloro-s-triazine sodium salt.

The following sensitizing dyes were used:

Senstizing Dye for Blue-Sensitive Layer:

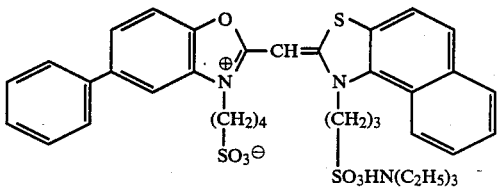

($7\times10^{-4}$ mol per mol of silver halide)

Sensitizing Dye for Green-Sensitive Layer:

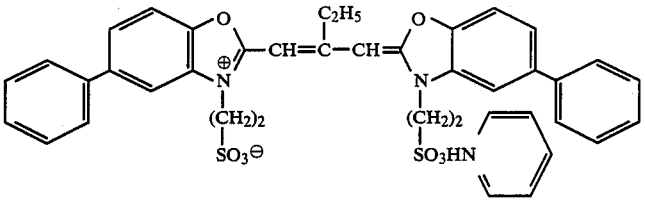

($4\times10^{-4}$ mol per mol of silver halide)

Sensitizing Dye for Red-Sensitive Layer:

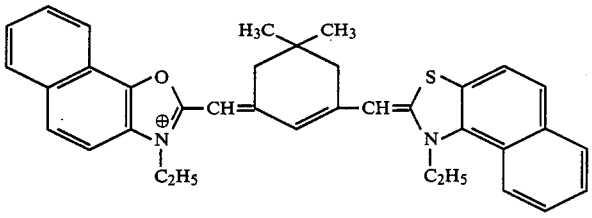

($2\times10^{-4}$ mol per mol of silver halide)

The following dyes were used as irradiation preventive dyes:

Irradiation Preventive Dye for Green-Sensitive Layer:

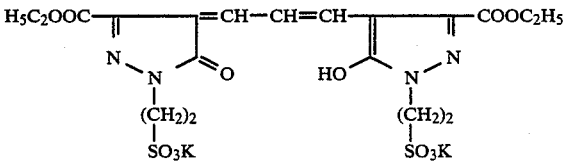

($2.1\times10^{-5}$ mol/m$^2$)

Irradiation Preventive Dye for Red-Sensitive Layer:

-continued
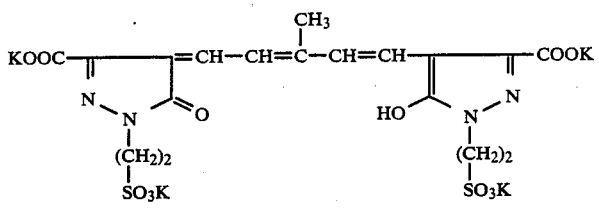
($2.0 \times 10^{-5}$ mol/m$^2$)
Structural formulae of the compounds, including couplers, used in this example were as follows:
Yellow Coupler (a)
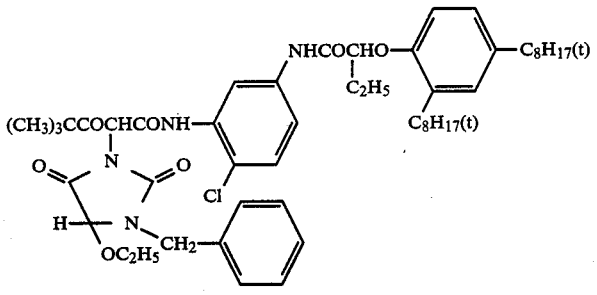
Yellow Coupler (b)
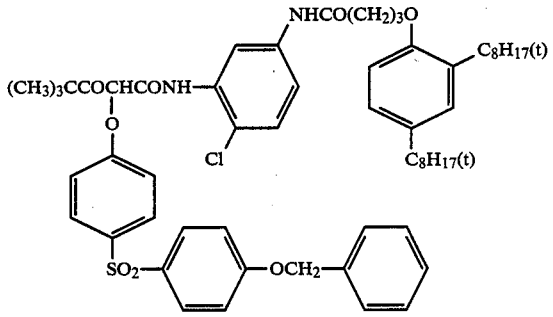
Magenta Coupler (a)
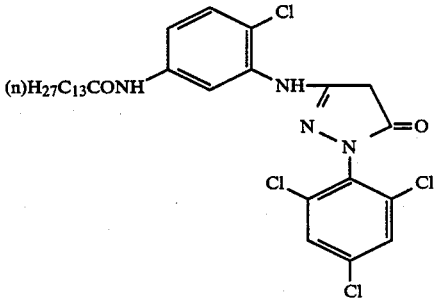
Magenta Coupler (b)

-continued
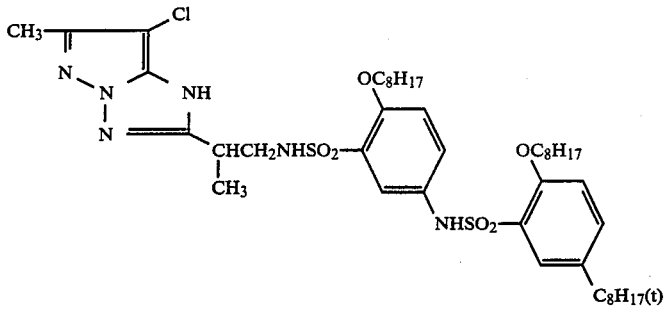
Magenta Coupler (c)
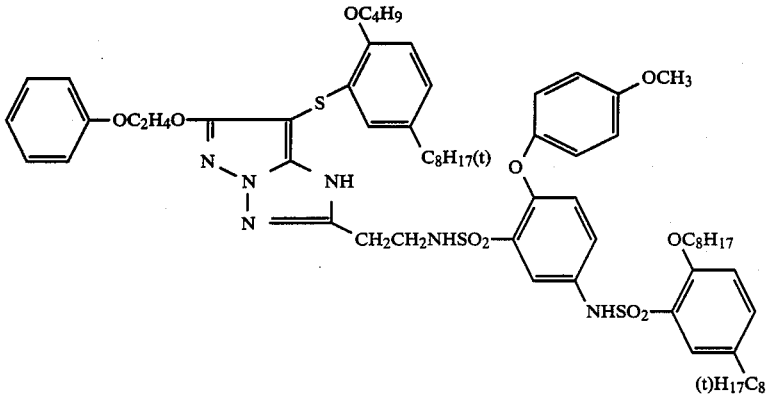
Magenta Coupler (d)
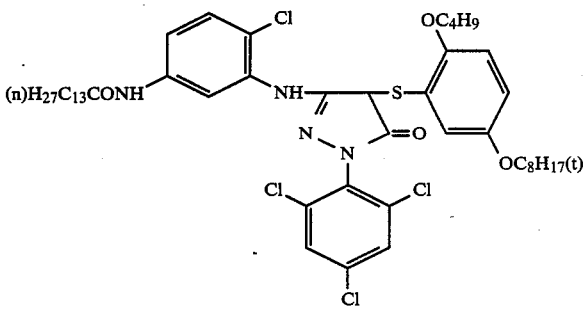
Cyan Coupler (a)
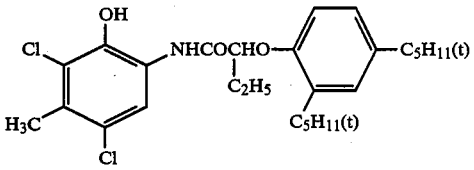
Cyan Coupler (b)
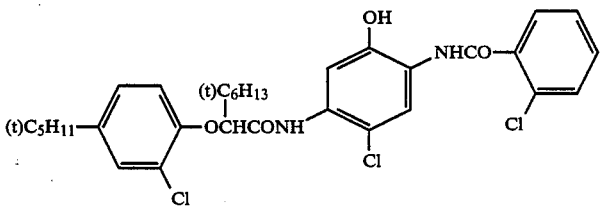
Cyan Coupler (c)

-continued
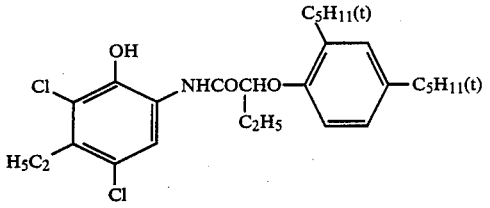
Color Image Stabilizer (a)
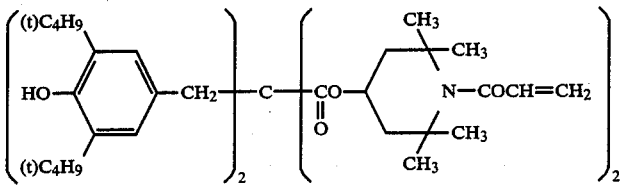
Color Image Stabilizer (b)
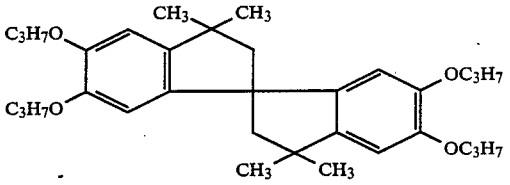
Color Image Stabilizer (c)
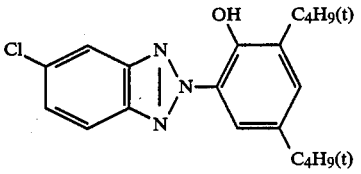
Color Image Stabilizer (d)
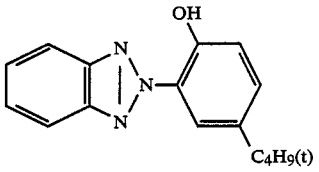
Color Image Stabilizer (e)
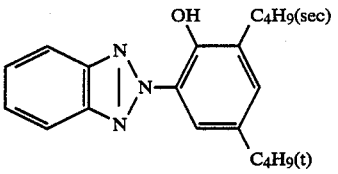
Ultraviolet Absorber (a)
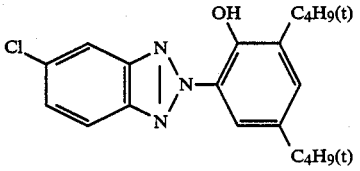
Ultraviolet Absorber (b)

-continued

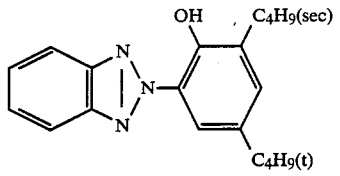

Ultraviolet Absorber (c)

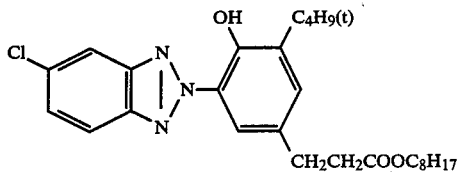

Color Mixing Preventive Agent (a)

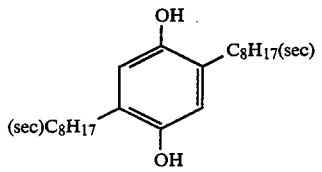

Color Mixing Preventive Agent (b)

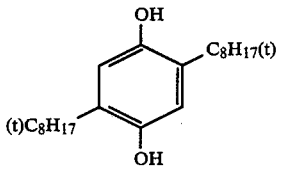

Solvent (a)

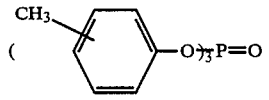

Solvent (b)

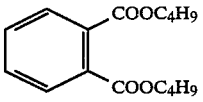

Solvent (c)

$(C_9H_{19}O)_3P{=}O$

Solvent (d)

$(C_8H_{17}O)_3P{=}O$

The balance of the viscosities and the surface tensions of the first to the seventh layer coating solutions were adjusted in a conventional manner, and the coating solutions were applied on a paper base the opposite surfaces of which were laminated with polyethylene to prepare Sample 301, the structure and composition of which is shown in Table B below.

In the same manner as above, except for changes shown in Table C, Samples 302 to 316 were prepared.

TABLE B

| Seventh Layer: Protective Layer | |
|---|---|
| Gelatin | 1.33 g/m$^2$ |
| Acryl-modified copolymer of polyvinyl alcohol (degree of modification: 17%) | 0.17 g/m$^2$ |
| **Sixth Layer: Ultraviolet Absorbing Layer** | |
| Gelatin | 0.54 g/m$^2$ |
| Ultraviolet absorber: 1:5:3 mixture* of (a), (b) and (c) | 5.10 × 10$^{-4}$ mol/m$^2$ |
| Solvent (b) | 0.08 g/m$^2$ |
| **Fifth Layer: Red-Sensitive Layer** | |
| Silver Chlorobromide Emulsion (2) | 0.22 g/m$^2$ |

TABLE B-continued

| | |
|---|---|
| | (silver) |
| Gelatin | 0.90 g/m$^2$ |
| Cyan coupler: 1:1 mixture* of (a) and (b) | 7.05 × 10$^{-4}$ mol/m$^2$ |
| Color image stabilizer: 1:3:3 mixture of (c), (d) and (e) (weight ratio) | 5.20 × 10$^{-4}$ mol/m$^2$ |
| Solvent (a) | 0.22 g/m$^2$ |
| **Fourth Layer: Ultraviolet Absorbing Layer** | |
| Gelatin | 1.60 g/m$^2$ |
| Ultraviolet absorber: 1:5:3 mixture* of (a), (b) and (c) | 1.70 × 10$^{-4}$ mol/m$^2$ |
| Color Mixing Preventing Agent (b) | 1.60 × 10$^{-4}$ mol/m$^2$ |
| Solvent (b) | 0.24 g/m$^2$ |
| **Third Layer: Green-Sensitive Layer** | |
| Silver Chlorobromide Emulsion (2) | 0.30 g/m$^2$ (silver) |
| Gelatin | 1.56 g/m$^2$ |
| Magenta Coupler (a) | 3.38 × 10$^{-4}$ mol/m$^2$ |
| Color Image Stabilizer (b) | 0.19 g/m$^2$ |
| Solvent: 1:1 mixture* of (a) and | 0.59 g/m$^2$ |
| **Second Layer: Color Mixing Preventing Layer** | |
| Gelatin | 0.90 g/m$^2$ |
| Color Mixing Preventing Agent (a) | 2.33 × 10$^{-4}$ mol/m$^2$ |
| **First Layer: Blue-Sensitive Layer** | |
| Silver Chlorobromide Emulsion (1) | 0.35 g/m$^2$ (silver) |
| Gelatin | 1.35 g/m$^2$ |
| Yellow Coupler (a) | 6.9 × 10$^{-4}$ mol/m$^2$ |
| Color Image Stabilizer (a) | 0.13 g/m$^2$ |
| Solvent: 1:1 mixture* of (b) and (c) | 0.02 g/m$^2$ |

Support:
*Polyethylene-laminated paper (the polyethylene on the first layer side contained white pigments ($TiO_2$, etc.) and bluish dyes (ultramarine blue, etc.))
*Molar ratio

TABLE C

| Sample No. | Emulsion: Blue-Sensitive Layer | Emulsion: Green-Sensitive Layer | Emulsion: Red-Sensitive Layer | Yellow Coupler for Blue-Sensitive Layer | Magenta Coupler for Green-Sensitive Layer | Cyan Coupler for Red-Sensitive Layer |
|---|---|---|---|---|---|---|
| 301 | (1) | (2) | (2) | (a) | (a) | (a) + (b)* |
| 302 | (1) | (2) | (2) | (a) | (b)*** | (a) + (b)* |
| 303 | (1) | (2) | (2) | (a) | (c)*** | (a) + (b)* |
| 304 | (1) | (2) | (2) | (a) | (d)*** | (a) + (b)* |
| 305 | (1) | (2) | (2) | (a) | (a) | (c) |
| 306 | (1) | (2) | (2) | (a) | (a) | (a) |
| 307 | (1) | (2) | (2) | (a) | (a) | (a) + PMMA** |
| 308 | (1) | (2) | (2) | (b) | (a) | (a) + (b)* |
| 309 | (3) | (4) | (4) | (a) | (a) | (a) + (b)* |
| 310 | (3) | (4) | (4) | (a) | (b)*** | (a) + (b)* |
| 311 | (3) | (4) | (4) | (a) | (c)*** | (a) + (b)* |
| 312 | (3) | (4) | (4) | (a) | (d)*** | (a) + (b)* |
| 313 | (3) | (4) | (4) | (a) | (a) | (c) |
| 314 | (3) | (4) | (4) | (a) | (a) | (a) |
| 315 | (3) | (4) | (4) | (a) | (a) | (a) + PMMA** |
| 316 | (3) | (4) | (4) | (b) | (a) | (a) + (b)* |

*(a) + (b) is a mixture of (a) and (b) in a molar ratio of 1:1
**PMMA stands for polymethyl methacrylate (average molecular weight: about 15,000), and in the case of (a) + PMMA, PMMA was used as much as 1.5 times (by weight) Cyan Coupler (a) and they were emulsified and dispersed together.
***When Magenta Coupler (b), (c) or (d) was used, the coating amount of silver in the green-sensitive layer was 0.5 times the case of Sample 301.

Samples 301 to 308 were exposed to light (10 cms) passed through a blue filter using a light source of 3,200° K. and were subjected to gray color forming to provide samples having densities of yellow, magenta and cyan, respectively, of 2.0. These samples were processed in accordance with the following steps:

| Step | Temperature (°C.) | Time Period |
|---|---|---|
| Color Development | 33 | 3 min 15 sec |
| Bleach-Fixing | 33 | 45 sec |
| Rinsing (1) | 33 | 20 sec |
| Rinsing (2) | 33 | 20 sec |
| Rinsing (3) | 33 | 20 sec |
| Drying | 70 | 50 sec |

The rinsings (1) to (3) were such that three-step countercurrent washing directed from the rinsing (3) to the rinsing (1) was carried out.

The compositions of the processing solutions were as follows:

| | |
|---|---|
| **Color Developing Solution:** | |
| Diethylenetriaminepentaacetic acid | 3.0 g |
| Benzyl alcohol | 15 ml |
| Diethylene glycol | 10 ml |
| Sodium sulfite | 2.0 g |
| Potassium bromide | 0.6 g |
| Potassium carbonate | 30 g |
| N—Ethyl-N—(β-methanesulfonamidoethyl)-3-methyl-4-aminoaniline sulfate | 5.5 g |
| Hydroxylamine sulfate | 4.0 g |
| Brightening agent (4,4'-diaminostilbene type) | 1.0 g |
| Water to make | 1 liter |
| pH | 10.20 |
| **Bleach-Fixing Solution:** | |
| Ferric complex salt (bleaching agent: a ferric ammonium salt of the organic acid given in Table 5) | 0.14 mol |
| Chelating agent (the organic acid given in Table 5) | 0.02 mol |
| Ammonium thiosulfate aqueous solution (700 g/liter) | 100 ml |
| Sodium sulfite | 17 g |
| Ammonium bromide | 40 g |
| Water to make | 1 liter |
| pH | 6.00 |

In this case, the chelating agent was of the same type of organic acid as that of the organic acid ferric ammonium salt used as a bleaching agent.

Rinsing Solutions (1) to (3):

Desalted water as in Example 3 was used.

With respect to the thus-obtained samples, the residual amount of silver was determined by fluorescent X-ray analysis. The results are given in Table 5.

TABLE 5

| No. | Sample No. | Organic Acid for Bleaching Agent And as Chelating Agent | Residual Amount of Silver ($\mu g/cm^2$) |
|---|---|---|---|
| 1* | 301 | Ethylenediaminetetraacetic Acid | 12.4 |
| 2* | 302 | " | 13.3 |
| 3* | 303 | " | 11.5 |
| 4* | 304 | " | 12.7 |
| 5* | 305 | " | 12.9 |
| 6* | 306 | " | 13.3 |
| 7* | 307 | " | 13.6 |
| 8* | 308 | " | 14.2 |
| 9 | 301 | Compound A-1 | 5.3 |
| 10 | 302 | " | 5.8 |
| 11 | 303 | " | 4.2 |
| 12 | 304 | " | 5.4 |
| 13 | 305 | " | 5.5 |
| 14 | 306 | " | 6.0 |
| 15 | 307 | " | 6.1 |
| 16 | 308 | " | 6.5 |
| 17 | 301 | Compound A-6 | 4.8 |
| 18 | 302 | " | 4.9 |
| 19 | 303 | " | 4.0 |
| 20 | 304 | " | 4.8 |
| 21 | 305 | " | 4.9 |
| 22 | 306 | " | 5.0 |
| 23 | 307 | " | 5.1 |
| 24 | 308 | " | 5.5 |
| 25 | 301 | Compound A-15 | 4.2 |
| 26 | 302 | " | 4.2 |
| 27 | 303 | " | 3.8 |
| 28 | 304 | " | 4.2 |
| 29 | 305 | " | 4.3 |
| 30 | 306 | " | 4.6 |
| 31 | 307 | " | 4.7 |
| 32 | 308 | " | 5.2 |

*Comparative samples

As is apparent from Table 5, in photographic materials where the type of magenta coupler was varied, the type of cyan coupler was varied, and the method of dispersing the cyan coupler was varied were processed using the bleach-fixing solutions according to the present invention, excellent images with a small residual amount of silver were obtained.

Samples 309 to 316 were exposed in the same manner as for Samples 301 to 308, and were processed using the following steps:

| Step | Processing Temperature (°C.) | Processing Period (sec) |
|---|---|---|
| Color Development | 35 | 45 |
| Bleach-Fixing | 33 | 30 |
| Rinsing (1) | 33 | 20 |
| Rinsing (2) | 33 | 20 |
| Rinsing (3) | 33 | 20 |
| Drying | 70 | 50 |

Color Developing Solution:

| | |
|---|---|
| Ethylenediaminetetraacetic acid disodium salt dihydrate | 2.0 g |
| Triethanolamine | 8.0 g |
| N,N—Diethylhydroxylamine | 4.2 g |
| Sodium sulfite | 0.1 g |
| Potassium carbonate | 25 g |
| Sodium chloride | 1.5 g |
| 4-Amino-3-methyl-N—ethyl-N—[β-(methanesulfonamido)ethyl]-p-phenylenediamine sulfate | 5.0 g |
| Brightening agent (4,4'-diaminostilbene type) | 3.0 g |
| Water to make | 1 liter |
| pH | 10.05 |

Bleach-Fixing Solution (Solution-A):

| | |
|---|---|
| Ferric complex salt (bleaching agent: a ferric ammonium salt of the organic acid given in Table 6) | 0.14 mol |
| Chelating agent (the organic acid given in Table 6) | 0.02 mol |
| Ammonium thiosulfate aqueous solution (700 g/liter) | 100 ml |
| Sodium sulfite | 17 g |
| Water to make | 1 liter |
| pH | 6.00 |

In this case, the chelating agent was of the same type of organic acid as that of the organic acid ferric ammonium salt used as a bleaching agent.

Bleach-Fixing Solution (Solution-B):

To the bleach-fixing solution (solution-A) was added ammonium bromide in an amount of 40 g/liter.

Rinsing Solutions (1) to (3):

Desalted water was used.

In the process A, the bleach-fixing solution-A was used, and in the process B, the bleach-fixing solution-B was used. The results are given in Table 6.

TABLE 6

| No. | Photographic Material | Organic Acid for Bleaching Agent And as Chelating Agent | Bleach-Fixing Solution-A Residual Amount of Silver ($\mu g/cm^2$) | Bleach-Fixing Solution-B Residual Amount of Siver ($\mu g/cm^2$) |
|---|---|---|---|---|
| 1* | 309 | Ethylenediamine-tetraacetic acid | 12.8 | 8.3 |
| 2* | 310 | " | 13.3 | 9.2 |
| 3* | 311 | " | 12.1 | 8.0 |
| 4* | 312 | " | 12.5 | 8.2 |
| 5* | 313 | " | 14.1 | 9.1 |
| 6* | 314 | " | 13.7 | 8.7 |
| 7* | 315 | " | 11.8 | 7.2 |
| 8* | 316 | " | 12.7 | 8.4 |
| 9 | 309 | Compound A-1 | 6.3 | 3.5 |
| 10 | 310 | " | 6.2 | 3.2 |
| 11 | 311 | " | 6.7 | 3.3 |
| 12 | 312 | " | 6.4 | 3.6 |
| 13 | 313 | " | 6.9 | 3.8 |
| 14 | 314 | " | 6.1 | 3.0 |
| 15 | 315 | " | 5.8 | 2.8 |
| 16 | 316 | " | 6.2 | 3.3 |
| 17 | 309 | Compound A-6 | 5.9 | 3.2 |
| 18 | 310 | " | 5.7 | 3.0 |

TABLE 6-continued

| No. | Photo-graphic Material | Organic Acid for Bleaching Agent And as Chelating Agent | Bleach-Fixing Solution-A Residual Amount of Silver ($\mu g/cm^2$) | Bleach-Fixing Solution-B Residual Amount of Siver ($\mu g/cm^2$) |
|---|---|---|---|---|
| 19 | 311 | " | 6.2 | 3.3 |
| 20 | 312 | " | 5.6 | 3.5 |
| 21 | 313 | " | 6.4 | 3.7 |
| 22 | 314 | " | 5.7 | 3.1 |
| 23 | 315 | " | 5.2 | 2.9 |
| 24 | 316 | " | 5.9 | 3.1 |
| 25 | 309 | Compound A-15 | 6.5 | 3.8 |
| 26 | 310 | " | 6.3 | 3.6 |
| 27 | 311 | " | 6.7 | 3.9 |
| 28 | 312 | " | 6.9 | 4.1 |
| 29 | 313 | " | 7.0 | 3.9 |
| 30 | 314 | " | 6.0 | 3.3 |
| 31 | 315 | " | 6.1 | 3.2 |
| 32 | 316 | " | 6.4 | 3.5 |

*Comparative samples

As is apparent from Table 6, the high silver chloride content coupler photographic materials wherein the type of magenta coupler was varied, the type of cyan coupler was varied, and the method of dispersing the cyan coupler was varied were processed using the bleach-fixing solutions according to the present invention, excellent photographic images with a small residual amount of silver were obtained. Further, when ammonium bromide was added to the bleach-fixing solution according to the present invention, excellent images with a smaller residual amount of silver were obtained.

According to the present invention, color photographic materials having high sensitivity and high silver content can undergo desilvering sufficiently in a short period of time without damaging the photographic characteristics. Further, when color photographic materials were processed continuously according to the present invention, excellent photographic images were obtained with a smaller amount of replenishing solutions required, and as a result, the amount of waste liquor can be decreased.

While the invention has been described in detail and with reference to specific embodiments thereof, it will be apparent to one skilled in the art that various changes and modifications can be made therein without departing from the spirit and scope thereof.

What is claimed is:

1. A method of processing an imagewise exposed silver halide color photographic material comprising developing the material with a color developing solution, and then processing the material with a solution having a bleaching ability, wherein said processing solution having a bleaching ability contains a ferric complex salt comprising an aminocarboxylic acid ferric salt, and, as a complexing agent, an aromatic compound having at least one group represented by the following general formula (I):

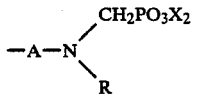

(I)

wherein X represents a hydrogen atom or an organic or inorganic cation, A represents a single bond or a divalent linking group, and R represents a hydrogen atom, and aliphatic group, an aromatic group, a heterocyclic group, an acyl group, a sulfonyl group, said A or $—CH_2PO_3X_2$ wherein X is as defined above, and wherein said aminopolycarboxylic acid ferric salt and said complexing agent are present in a molar ratio of from about 1/10 to about 10/1 and further provided that said ferric complex salt is present in said processing solution in an amount of from about 0.1 to about 1 mol per liter.

2. The method of claim 1, wherein said aromatic compounds having at least one group represented by general formula (I) are compounds represented by the following general formula (II):

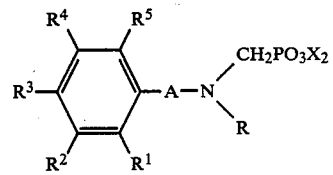

(II)

wherein X, R and A have the same meaning as defined in general formula (I), $R^1$, $R^2$, $R^3$, $R^4$ and $R^5$, which may be the same or different, each represents a hydrogen atom, an aliphatic group, an aromatic group, a heterocyclic group, an alkoxy group, an aryloxy group, an alkylthio group, an arylthio group, an alkylamino group, an acylamino group, a sulfonamide group, an acyl group, a sulfo group, a carboxyl group, a sulfamoyl group, a carbamoyl group, an alkoxycarbonyl group, an alkoxysulfonyl group, a sulfonyl group, a halogen atom, a nitro group, a ureido group, a urethane group, a cyano group, an amino group, a hydroxyl group, an acyloxy group, a sulfonyloxy group, a heterocyclic oxy group, a mercapto group or $—CH_2PO_3X_2$ (X being defined as above), $R^1$ and R may join together to form a 5-membered or 6-membered ring, and two of $R^1$, $R^2$, $R^3$, $R^4$ and $R^5$ that are at ortho positions with respect to each other may join to form a 5-membered or 6-membered ring or a spiro ring.

3. The method of claim 2, wherein said compounds represented by general formula (II) are compounds wherein R represents $—CH_2PO_3X_2$.

4. The method of claim 3, wherein said compounds represented by general formula (II) are compounds represented by general formula (III):

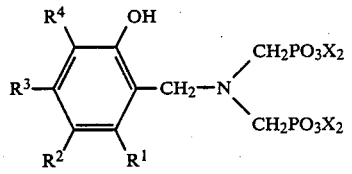

(III)

wherein X, $R^1$, $R^2$, $R^3$ and $R^4$ have the same meaning as defined in general formula (II).

5. The method of claim 1, wherein said complexing agent is in the form of ferric complex salts or is used together with a ferric salt.

6. The method claim 5, wherein said ferric salt is selected from the group consisting of ferric sulfate, ferric nitrate, ferric chloride, and ferric ammonium sulfate to form a ferric complex ion in solution.

7. The method of claim 1, wherein said ferric complex salt is present in an amount of from 0.2 to 0.5 mol per liter.

8. The method of claim 1, wherein said processing solution having a bleaching ability is a bleaching solution.

9. The method of claim 1, wherein said processing solution having a bleaching ability is a bleach-fixing solution.

* * * * *